US008519990B2

(12) United States Patent
Yamazaki et al.

(10) Patent No.: US 8,519,990 B2
(45) Date of Patent: Aug. 27, 2013

(54) SEMICONDUCTOR DISPLAY DEVICE

(75) Inventors: Shunpei Yamazaki, Setagaya (JP); Jun Koyama, Sagamihara (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 335 days.

(21) Appl. No.: 13/070,510

(22) Filed: Mar. 24, 2011

(65) Prior Publication Data

US 2011/0242070 A1 Oct. 6, 2011

(30) Foreign Application Priority Data

Mar. 31, 2010 (JP) ..... 2010-080661

(51) Int. Cl.
*G09G 5/00* (2006.01)

(52) U.S. Cl.
USPC ..... 345/204; 345/98; 345/100; 257/43; 348/752; 348/753; 348/796; 348/722

(58) Field of Classification Search
USPC ..... 345/204–206, 92–100; 257/43, 257/52, 55, 66–67; 438/718, 721, 722, 752, 438/753, 754, 758, 796
See application file for complete search history.

(56) References Cited

U.S. PATENT DOCUMENTS

| | | | |
|---|---|---|---|
| 5,261,156 | A | 11/1993 | Mase et al. |
| 5,731,856 | A | 3/1998 | Kim et al. |
| 5,744,864 | A | 4/1998 | Cillessen et al. |
| 6,294,274 | B1 | 9/2001 | Kawazoe et al. |
| 6,420,988 | B1 | 7/2002 | Azami et al. |
| 6,563,174 | B2 | 5/2003 | Kawasaki et al. |
| 6,727,522 | B1 | 4/2004 | Kawasaki et al. |
| 7,049,190 | B2 | 5/2006 | Takeda et al. |
| 7,061,014 | B2 | 6/2006 | Hosono et al. |

(Continued)

FOREIGN PATENT DOCUMENTS

| | | |
|---|---|---|
| CN | 1941299 | 4/2007 |
| EP | 1 737 044 | 12/2006 |

(Continued)

OTHER PUBLICATIONS

International Search Report (Application No. PCT/JP2011/055559) Dated May 31, 2011.

(Continued)

*Primary Examiner* — Hong Zhou
(74) *Attorney, Agent, or Firm* — Eric J. Robinson; Robinson Intellectual Property Law Office, P.C.

(57) ABSTRACT

A semiconductor display device comprising a pixel portion and a signal line driver circuit comprising a first circuit, a second circuit configured to control timing of the sampled serial video signals by the first circuit, and a third circuit configured to perform signal processing on the parallel video signals, wherein the second circuit comprises a first semiconductor element formed over a first substrate, the first semiconductor element including a first semiconductor layer, wherein the third circuit comprises a second semiconductor element formed over a second substrate, the second semiconductor element including a second semiconductor layer, wherein the pixel portion comprises a third semiconductor element formed over the second substrate, the third semiconductor element including a third semiconductor layer, wherein the first semiconductor layer comprises silicon or germanium, and wherein each the second semiconductor layer and the third semiconductor layer has a wider bandgap than the first semiconductor layer.

25 Claims, 20 Drawing Sheets

(56) References Cited

U.S. PATENT DOCUMENTS

| | | | | |
|---|---|---|---|---|
| 7,064,346 | B2 | 6/2006 | Kawasaki et al. | |
| 7,105,868 | B2 | 9/2006 | Nause et al. | |
| 7,211,825 | B2 | 5/2007 | Shih et al | |
| 7,282,782 | B2 | 10/2007 | Hoffman et al. | |
| 7,297,977 | B2 | 11/2007 | Hoffman et al. | |
| 7,323,356 | B2 | 1/2008 | Hosono et al. | |
| 7,385,224 | B2 | 6/2008 | Ishii et al. | |
| 7,402,506 | B2 | 7/2008 | Levy et al. | |
| 7,411,209 | B2 | 8/2008 | Endo et al. | |
| 7,453,065 | B2 | 11/2008 | Saito et al. | |
| 7,453,087 | B2 | 11/2008 | Iwasaki | |
| 7,462,862 | B2 | 12/2008 | Hoffman et al. | |
| 7,468,304 | B2 | 12/2008 | Kaji et al. | |
| 7,501,293 | B2 | 3/2009 | Ito et al. | |
| 7,674,650 | B2 | 3/2010 | Akimoto et al. | |
| 7,732,819 | B2 | 6/2010 | Akimoto et al. | |
| 7,910,490 | B2 | 3/2011 | Akimoto et al. | |
| 7,932,521 | B2 | 4/2011 | Akimoto et al. | |
| 8,134,156 | B2 * | 3/2012 | Akimoto | 257/72 |
| 2001/0046027 | A1 | 11/2001 | Tai et al. | |
| 2002/0056838 | A1 | 5/2002 | Ogawa | |
| 2002/0132454 | A1 | 9/2002 | Ohtsu et al. | |
| 2003/0189401 | A1 | 10/2003 | Kido et al. | |
| 2003/0218222 | A1 | 11/2003 | Wager et al. | |
| 2004/0038446 | A1 | 2/2004 | Takeda et al. | |
| 2004/0127038 | A1 | 7/2004 | Carcia et al. | |
| 2005/0017302 | A1 | 1/2005 | Hoffman | |
| 2005/0199959 | A1 | 9/2005 | Chiang et al. | |
| 2006/0035452 | A1 | 2/2006 | Carcia et al. | |
| 2006/0043377 | A1 | 3/2006 | Hoffman et al. | |
| 2006/0091793 | A1 | 5/2006 | Baude et al. | |
| 2006/0108529 | A1 | 5/2006 | Saito et al. | |
| 2006/0108636 | A1 | 5/2006 | Sano et al. | |
| 2006/0110867 | A1 | 5/2006 | Yabuta et al. | |
| 2006/0113536 | A1 | 6/2006 | Kumomi et al. | |
| 2006/0113539 | A1 | 6/2006 | Sano et al. | |
| 2006/0113549 | A1 | 6/2006 | Den et al. | |
| 2006/0113565 | A1 | 6/2006 | Abe et al. | |
| 2006/0169973 | A1 | 8/2006 | Isa et al. | |
| 2006/0170111 | A1 | 8/2006 | Isa et al. | |
| 2006/0197092 | A1 | 9/2006 | Hoffman et al. | |
| 2006/0208977 | A1 | 9/2006 | Kimura | |
| 2006/0228974 | A1 | 10/2006 | Thelss et al. | |
| 2006/0231882 | A1 | 10/2006 | Kim et al. | |
| 2006/0238135 | A1 | 10/2006 | Kimura | |
| 2006/0244107 | A1 | 11/2006 | Sugihara et al. | |
| 2006/0284171 | A1 | 12/2006 | Levy et al. | |
| 2006/0284172 | A1 | 12/2006 | Ishii | |
| 2006/0292777 | A1 | 12/2006 | Dunbar | |
| 2007/0024187 | A1 | 2/2007 | Shin et al. | |
| 2007/0046191 | A1 | 3/2007 | Saito | |
| 2007/0052025 | A1 | 3/2007 | Yabuta | |
| 2007/0054507 | A1 | 3/2007 | Kaji et al. | |
| 2007/0072439 | A1 | 3/2007 | Akimoto et al. | |
| 2007/0090365 | A1 | 4/2007 | Hayashi et al. | |
| 2007/0108446 | A1 | 5/2007 | Akimoto | |
| 2007/0152217 | A1 | 7/2007 | Lai et al. | |
| 2007/0172591 | A1 | 7/2007 | Seo et al. | |
| 2007/0187678 | A1 | 8/2007 | Hirao et al. | |
| 2007/0187760 | A1 | 8/2007 | Furuta et al. | |
| 2007/0194379 | A1 | 8/2007 | Hosono et al. | |
| 2007/0252928 | A1 | 11/2007 | Ito et al. | |
| 2007/0272922 | A1 | 11/2007 | Kim et al. | |
| 2007/0287296 | A1 | 12/2007 | Chang | |
| 2008/0006877 | A1 | 1/2008 | Mardilovich et al. | |
| 2008/0038882 | A1 | 2/2008 | Takechi et al. | |
| 2008/0038929 | A1 | 2/2008 | Chang | |
| 2008/0050595 | A1 | 2/2008 | Nakagawara et al. | |
| 2008/0073653 | A1 | 3/2008 | Iwasaki | |
| 2008/0083950 | A1 | 4/2008 | Pan et al. | |
| 2008/0106191 | A1 | 5/2008 | Kawase | |
| 2008/0128689 | A1 | 6/2008 | Lee et al. | |
| 2008/0129195 | A1 | 6/2008 | Ishizaki et al. | |
| 2008/0166834 | A1 | 7/2008 | Kim et al. | |
| 2008/0182358 | A1 | 7/2008 | Cowdery-Corvan et al. | |
| 2008/0224133 | A1 | 9/2008 | Park et al. | |
| 2008/0254569 | A1 | 10/2008 | Hoffman et al. | |
| 2008/0258139 | A1 | 10/2008 | Ito et al. | |
| 2008/0258140 | A1 | 10/2008 | Lee et al. | |
| 2008/0258141 | A1 | 10/2008 | Park et al. | |
| 2008/0258143 | A1 | 10/2008 | Kim et al. | |
| 2008/0284710 | A1 * | 11/2008 | Kimura et al. | 345/98 |
| 2008/0296568 | A1 | 12/2008 | Ryu et al. | |
| 2008/0308796 | A1 | 12/2008 | Akimoto et al. | |
| 2008/0308805 | A1 | 12/2008 | Akimoto et al. | |
| 2008/0308806 | A1 | 12/2008 | Akimoto et al. | |
| 2009/0008639 | A1 | 1/2009 | Akimoto et al. | |
| 2009/0068773 | A1 | 3/2009 | Lai et al. | |
| 2009/0073325 | A1 | 3/2009 | Kuwabara et al. | |
| 2009/0114910 | A1 | 5/2009 | Chang | |
| 2009/0114923 | A1 * | 5/2009 | Iwamuro | 257/77 |
| 2009/0134399 | A1 | 5/2009 | Sakakura et al. | |
| 2009/0152506 | A1 | 6/2009 | Umeda et al. | |
| 2009/0152541 | A1 | 6/2009 | Maekawa et al. | |
| 2009/0278122 | A1 | 11/2009 | Hosono et al. | |
| 2009/0280600 | A1 | 11/2009 | Hosono et al. | |
| 2009/0305461 | A1 | 12/2009 | Akimoto et al. | |
| 2010/0065844 | A1 | 3/2010 | Tokunaga | |
| 2010/0092800 | A1 | 4/2010 | Itagaki et al. | |
| 2010/0109002 | A1 | 5/2010 | Itagaki et al. | |
| 2010/0136743 | A1 | 6/2010 | Akimoto et al. | |
| 2010/0163868 | A1 | 7/2010 | Yamazaki et al. | |
| 2011/0104851 | A1 | 5/2011 | Akimoto et al. | |
| 2011/0117697 | A1 | 5/2011 | Akimoto et al. | |
| 2011/0121290 | A1 | 5/2011 | Akimoto et al. | |

FOREIGN PATENT DOCUMENTS

| | | | |
|---|---|---|---|
| EP | 1770788 | A | 4/2007 |
| EP | 1995787 | A | 11/2008 |
| EP | 1998373 | A | 12/2008 |
| EP | 1998374 | A | 12/2008 |
| EP | 1998375 | A | 12/2008 |
| EP | 2 226 847 | | 9/2010 |
| JP | 60-198861 | | 10/1985 |
| JP | 63-210022 | | 8/1988 |
| JP | 63-210023 | | 8/1988 |
| JP | 63-210024 | | 8/1988 |
| JP | 63-215519 | | 9/1988 |
| JP | 63-239117 | | 10/1988 |
| JP | 63-265818 | | 11/1988 |
| JP | 05-045668 | A | 2/1993 |
| JP | 05-251705 | | 9/1993 |
| JP | 07-014880 | A | 1/1995 |
| JP | 08-264794 | | 10/1996 |
| JP | 11-505377 | | 5/1999 |
| JP | 2000-044236 | | 2/2000 |
| JP | 2000-150900 | | 5/2000 |
| JP | 2000-341125 | A | 12/2000 |
| JP | 2002-076356 | | 3/2002 |
| JP | 2002-289859 | | 10/2002 |
| JP | 2003-086000 | | 3/2003 |
| JP | 2003-086808 | | 3/2003 |
| JP | 2004-103957 | | 4/2004 |
| JP | 2004-273614 | | 9/2004 |
| JP | 2004-273732 | | 9/2004 |
| JP | 2007-123861 | A | 5/2007 |
| JP | 2007-286119 | A | 11/2007 |
| JP | 2010-003910 | A | 1/2010 |
| WO | WO 2004/114391 | | 12/2004 |

OTHER PUBLICATIONS

Written Opinion (Application No. PCT/JP2011/055559) Dated May 31, 2011.

Fortunato et al., "Wide-Bandgap High-Mobility ZNO Thin-Film Transistors Produced at Room Temperature," Appl. Phys. Lett. (Applied Physics Letters), Sep. 27, 2004, vol. 85, No. 13, pp. 2541-2543.

Dembo et al., "RFCPUS on Glass and Plastic Substrates Fabricated by TFT Transfer Technology," IEDM 05: Technical Digest of International Electron Devices Meeting, Dec. 5, 2005, pp. 1067-1069.

Ikeda et al., "Full-Functional System Liquid Crystal Display using CG-Silicon Technology," SID Digest '04: SID International Symposium Digest of Technical Papers, 2004, vol. 35, pp. 860-863.

Nomura et al., "Room-Temperature Fabrication of Transparent Flexible Thin-Film Transistors Using Amorphous Oxide Semiconductors," Nature, Nov. 25, 2004, vol. 432, pp. 488-492.
Park et al., "Improvements in the Device Characteristics of Amorphous Indium Gallium Zinc Oxide Thin-Film Transistors by Ar Plasma Treatment," Appl. Phys. Lett. (Applied Physics Letters), Jun. 26, 2007, vol. 90, No. 26, pp. 262106-1-262106-3.
Takahashi et al., "Theoretical Analysis of IGZO Transparent Amorphous Oxide Semiconductor," IDW '08: Proceedings of the 15th International Display Workshops, Dec. 3, 2008, pp. 1637-1640.
Hayashi et al., "42.1: Invited Paper: Improved Amorphous In—Ga—ZnO TFTs," SID Digest '08: SID International Symposium Digest of Technical Papers, May 20, 2008, vol. 39, pp. 621-624.
Prins et al., "A Ferroelectric Transparent Thin-Film Transistor," Appl. Phys. Lett. (Applied Physics Letters), Jun. 17, 1996, vol. 68, No. 25, pp. 3650-3652.
Nakamura et al., "The Phase Relations in the $In_2O_3$—$Ga_2ZnO_4$—ZnO System at 1350° C.," Journal of Solid State Chemistry, Aug. 1, 1991, vol. 93, No. 2, pp. 298-315.
Kimizuka et al., "Syntheses and Single-Crystal Data of Homologous Compounds, $In_2O_3(ZnO)m$ ($m$=3, 4, and 5), $InGaO_3(ZnO)_3$, and $Ga_2O_3(ZnO)m$ ($m$=7, 8, 9, and 16) in the $In_2O_3$—$ZnGa_2O_4$—ZnO System," Journal of Solid State Chemistry, Apr. 1, 1995, vol. 116, No. 1, pp. 170-178.
Nomura et al., "Thin-Film Transistor Fabricated in Single-Crystalline Transparent Oxide Semiconductor," Science, May 23, 2003, vol. 300, No. 5623, pp. 1269-1272.
Masuda et al., "Transparent thin film transistors using ZnO as an active channel layer and their electrical properties," J. Appl. Phys. (Journal of Applied Physics), Feb. 1, 2003, vol. 93, No. 3, pp. 1624-1630.
Asakuma et al., "Crystallization and Reduction of Sol-Gel-Derived Zinc Oxide Films by Irradiation with Ultraviolet Lamp," Journal of Sol-Gel Science and Technology, 2003, vol. 26, pp. 181-184.
Osada et al., "15.2: Development of Driver-Integrated Panel using Amorphous In—Ga—Zn—Oxide TFT," SID Digest '09: SID International Symposium Digest of Technical Papers, May 31, 2009, pp. 184-187.
Nomura et al., "Carrier transport in transparent oxide semiconductor with intrinsic structural randomness probed using single-crystalline $InGaO_3(ZnO)_5$films," Appl. Phys. Lett. (Applied Physics Letters), Sep. 13, 2004, vol. 85, No. 11, pp. 1993-1995.
Li et al., "Modulated Structures of Homologous Compounds $InMO_3(ZnO)m$ (M=In,Ga; m=Integer) Described by Four-Dimensional Superspace Group," Journal of Solid Stae Chemistry, 1998, vol. 139, pp. 347-355.
Son et al., "42.4L: Late-News Paper: 4 Inch QVGA AMOLED Driven by the Threshold Voltage Controlled Amorphous GIZO ($Ga_2O_3$—$In_2O_3$—ZnO) TFT," SID Digest '08: SID International Symposium Digest of Technical Papers, May 20, 2008, vol. 39, pp. 633-636.
Lee et al., "World's Largest (15-inch) XGA AMLCD Panel using IGZO Oxide TFT," SID Digest '08: SID International Symposium Digest of Technical Papers, May 20, 2008, vol. 39, pp. 625-628.
Nowatari et al., "60.2: Intermediate Connector with Suppressed Voltage Loss for White Tandem OLEDs," SID Digest '09: SID International Symposium Digest of Technical Papers, May 31, 2009, vol. 40, pp. 899-902.
Kanno et al., "White Stacked Electrophosphorecent Organic Light-Emitting Devices Employing $MoO_3$ as a Charge-Generation Layer," Adv. Mater. (Advanced Materials), 2006, vol. 18, No. 3, pp. 339-342.
Tsuda et al., "Ultra Low Power Consumption Technologies for Mobile TFT-LCDs," IDW '02: Proceedings of the 9th International Display Workshops, Dec. 4, 2002, pp. 295-298.
Van de Walle, "Hydrogen as a Cause of Doping in Zinc Oxide," Phys. Rev. Lett. (Physical Review Letters), Jul. 31, 2000, vol. 85, No. 5, pp. 1012-1015.
Fung et al., "2-D Numerical Simulation of High Performance Amorphous In—Ga—Zn—O TFTs for Flat Panel Displays," AM-FPD '08 Digest of Technical Papers, Jul. 2, 2008, pp. 251-252, The Japan Society of Applied Physics.
Jeong et al., "3.1: Distinguished Paper: 12.1-Inch WXGA AMOLED Display Driven by Indium—Gallium—Zinc Oxide TFTs Array," SID Digest '08: SID International Symposium Digest of Technical Papers, May 20, 2008, vol. 39, No. 1, pp. 1-4.
Park et al., "High performance amorphous oxide thin film transistors with self-aligned top-gate structure," IEDM 09: Technical Digest of International Electron Devices Meeting, Dec. 7, 2009, pp. 191-194.
Kurokawa et al., "UHF RFCPUs on Flexible and Glass Substrates for Secure RFID Systems," Journal of Solid-State Circuits, 2008, vol. 43, No. 1, pp. 292-299.
Ohara et al., "Amorphous In—Ga—Zn—Oxide TFTs with Suppressed Variation for 4.0 inch QVGA AMOLED Display," AM-FPD '09 Digest of Technical Papers, Jul. 1, 2009, pp. 227-230, The Japan Society of Applied Physics.
Coates et al., "Optical Studies of the Amorphous Liquid-Cholesteric Liquid Crystal Transition: The "Blue Phase"," Physics Letters, Sep. 10, 1973, vol. 45A, No. 2, pp. 115-116.
Cho et al., "21.2: Al and Sn-doped Zinc Indium Oxide Thin Film Transistors for AMOLED Back-Plane," SID Digest '09: SID International Symposium Digest of Technical Papers, May 31, 2009, pp. 280-283.
Lee et al., "15.4: Excellent Performance of Indium—Oxide-Based Thin-Film Transistors by DC Sputtering," SID Digest '09: SID International Symposium Digest of Technical Papers, May 31, 2009, pp. 191-193.
Jin et al., "65.2: Distinguished Paper: World-Largest (6.5") Flexible Full Color Top Emission AMOLED Display on Plastic Film and Its Bending Properties," SID Digest '09: SID International Symposium Digest of Technical Papers, May 31, 2009, pp. 983-985.
Sakata et al., "Development of 4.0-In. AMOLED Display with Driver Circuit Using Amorphous In—Ga—Zn—Oxide TFTs," IDW '09: Proceedings of the 16th International Display Workshops, 2009, pp. 689-692.
Park et al., "Amorphous Indium—Gallium—Zinc Oxide TFTs and their Application for Large Size AMOLED," AM-FPD '08 Digest of Technical Papers, Jul. 2, 2008, pp. 275-278.
Park et al., "Challenge to Future Displays: Transparent AM-OLED Driven by PEALD Grown ZnO TFT," IMID '07 Digest, 2007, pp. 1249-1252.
Godo et al., "Temperature Dependence of Characteristics and Electronic Structure for Amorphous In-Ga-Zn-Oxide TFT," AM-FPD '09 Digest of Technical Papers, Jul. 1, 2009, pp. 41-44.
Osada et al., "Development of Driver-Integrated Panel using Amorphous In—Ga—Zn—Oxide TFT," AM-FPD '09 Digest of Technical Papers, Jul. 1, 2009, pp. 33-36.
Hirao et al., "Novel Top-Gate Zinc Oxide Thin-Film Transistors (ZnO TFTs) for AMLCDs," Journal of the SID, 2007, vol. 15, No. 1, pp. 17-22.
Hosono, "68.3: Invited Paper: Transparent Amorphous Oxide Semiconductors for High Performance TFT," SID Digest '07: SID International Symposium Digest of Technical Papers, 2007, vol. 38, pp. 1830-1833.
Godo et al., "P-9: Numerical Analysis on Temperature Dependence of Characteristics of Amorphous In—Ga—Zn—Oxide TFT," SID Digest '09: SID International Symposium Digest of Technical Papers, May 31, 2009, pp. 1110-1112.
Ohara et al., "21.3: 4.0 in. QVGA AMOLED Display Using In-Ga-Zn-Oxide TFTs with a Novel Passivation Layer," SID Digest '09: SID International Symposium Digest of Technical Papers, May 31, 2009, pp. 284-287.
Miyasaka, "58.2: Invited Paper: Suftla Flexible Microelectronics on their Way to Business," SID Digest '07: SID International Symposium Digest of Technical Papers, 2007, vol. 38, pp. 1673-1676.
Chern et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.
Kikuchi et al., "39.1: Invited Paper: Optically Isotropic NANO-Structured Liquid Crystal Composites for Display Applications," SID Digest '09: SID International Symposium Digest of Technical Papers, May 31, 2009, pp. 578-581.
Asaoka et al., "29.1: Polarizer-Free Reflective LCD Combined With Ultra Low-Power Driving Technology," SID Digest '09: SID International Symposium Digest of Technical Papers, May 31, 2009, pp. 395-398.

Lee et al., "Current Status of, Challenges to, and Perspective View of AM-OLED," IDW '06: Proceedings of the 13th International Display Workshops, Dec. 7, 2006, pp. 663-666.
Kikuchi et al., "62.2: Invited Paper: Fast Electro-Optical Switching in Polymer-Stabilized Liquid Crystalline Blue Phases for Display Application," SID Digest '07: SID International Symposium Digest of Technical Papers, 2007, vol. 38, pp. 1737-1740.
Nakamura, "Synthesis of Homologous Compound with New Long-Period Structure," Nirim Newsletter, Mar. 1, 1995, vol. 150, pp. 1-5.
Kikuchi et al., "Polymer-Stabilized Liquid Crystal Blue Phases," Nature Materials, Sep. 2, 2002, vol. 1, pp. 64-68.
Kimizuka et al., "Spinel, $YbFe_2O_4$, and $Yb_2Fe_3O_7$ Types of Structures for Compounds in the $In_2O_3$ and $Sc_2O_3$-$A_2O_3$-BO Systems [A: Fe, Ga, or Al; B: Mg, Mn, Fe, Ni, Cu, or Zn] at Temperatures Over 1000° C." Journal of Solid State Chemistry, 1985, vol. 60, pp. 382-384.
Kitzerow et al., "Observation of Blue Phases in Chiral Networks," Liquid Crystals, 1993, vol. 14, No. 3, pp. 911-916.
Costello et al., "Electron Microscopy of a Cholesteric Liquid Crystal and its Blue Phase," Phys. Rev. A (Physical Review A), May 1, 1984, vol. 29, No. 5, pp. 2957-2959.
Meiboom et al., "Theory of the Blue Phase of Cholesteric Liquid Crystals," Phys. Rev. Lett. (Physical Review Letters), May 4, 1981, vol. 46, No. 18, pp. 1216-1219.
Park et al., "42.3: Transparent ZnO Thin Film Transistor for the Application of High Aperture Ratio Bottom Emission AM-OLED Display," SID Digest '08: SID International Symposium Digest of Technical Papers, May 20, 2008, vol. 39, pp. 629-632.
Orita et al., "Mechanism of Electrical Conductivity of Transparent $InGaZnO_4$," Phys. Rev. B (Physical Review B), Jan. 15, 2000, vol. 61, No. 3, pp. 1811-1816.
Nomura et al., "Amorphous Oxide Semiconductors for High-Performance Flexible Thin-Film Transistors," Jpn. J. Appl. Phys. (Japanese Journal of Applied Physics), 2006, vol. 45, No. 5B, pp. 4303-4308.
Janotti et al., "Native Point Defects in ZnO," Phys. Rev. B (Physical Review B), Oct. 4, 2007, vol. 76, No. 16, pp. 165202-1-165202-22.
Park et al., "Electronic Transport Properties of Amorphous Indium-Gallium-Zinc Oxide Semiconductor Upon Exposure to Water," Appl. Phys. Lett. (Applied Physics Letters), 2008, vol. 92, pp. 072104-1-072104-3.
Hsieh et al., "P-29: Modeling of Amorphous Oxide Semiconductor Thin Film Transistors and Subgap Density of States," SID Digest '08: SID International Symposium Digest of Technical Papers, 2008, vol. 39, pp. 1277-1280.
Janotti et al., "Oxygen Vacancies in ZnO," Appl. Phys. Lett. (Applied Physics Letters), 2005, vol. 87, pp. 122102-1-122102-3.
Oba et al., "Defect energetics in ZnO: A hybrid Hartree-Fock density functional study," Phys. Rev. B (Physical Review B), 2008, vol. 77, pp. 245202-1-245202-6.
Orita et al., "Amorphous transparent conductive oxide $InGaO_3(ZnO)_m$ (m<4): a Zn 4s conductor," Philosophical Magazine, 2001, vol. 81, No. 5, pp. 501-515.
Hosono et al., "Working hypothesis to explore novel wide band gap electrically conducting amorphous oxides and examples," J. Non-Cryst. Solids (Journal of Non-Crystalline Solids), 1996, vol. 198-200, pp. 165-169.
Mo et al., "Amorphous Oxide TFT Backplanes for Large Size AMOLED Displays," IDW '08: Proceedings of the 6th International Display Workshops, Dec. 3, 2008, pp. 581-584.
Kim et al., "High-Performance oxide thin film transistors passivated by various gas plasmas," 214th ECS Meeting, 2008, No. 2317.
Clark et al., "First Principles Methods Using CASTEP," Zeitschrift fur Kristallographie, 2005, vol. 220, pp. 567-570.
Lany et al., "Dopability, Intrinsic Conductivity, and Nonstoichiometry of Transparent Conducting Oxides," Phys. Rev. Lett. (Physical Review Letters), Jan. 26, 2007, vol. 98, pp. 045501-1-045501-4.
Park et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.
Oh et al., "Improving the Gate Stability of ZnO Thin-Film Transistors with Aluminum Oxide Dielectric Layers," J. Electrochem. Soc. (Journal of the Electrochemical Society), 2008, vol. 155, No. 12, pp. H1009-H1014.
Ueno et al., "Field-Effect Transistor on $SrTiO_3$ with Sputtered $Al_2O_3$ Gate Insulator," Appl. Phys. Lett. (Applied Physics Letters), Sep. 1, 2003, vol. 83, No. 9, pp. 1755-1757.

* cited by examiner

SEMICONDUCTOR DISPLAY DEVICE

TECHNICAL FIELD

The present invention relates to a semiconductor display device including a driver circuit.

BACKGROUND ART

A semiconductor display device in which a transistor including amorphous silicon is provided in a pixel portion has advantages of high productivity and low cost because the semiconductor display device is applicable to a glass substrate of the fifth generation (1200 mm long×1300 mm wide) or higher generations. Further, in the semiconductor display device, a driver circuit such as a scan line driver circuit for selecting a pixel or a signal line driver circuit for supplying a video signal to the selected pixel is required to operate at high speed. Therefore, the driver circuit is formed using crystalline silicon such as single crystal silicon, which has higher mobility than amorphous silicon.

In general, an IC chip including a driver circuit formed using a single crystal silicon wafer or the like is mounted in the periphery of a pixel portion formed using amorphous silicon by a tape automated bonding (TAB) method, a chip on glass (COG) method, or the like.

Patent Document 1 cited below discloses a technique by which a driver circuit formed in the form of an IC chip using silicon is mounted on a panel. Patent Document 2 discloses a technique in which a driver circuit formed over a glass substrate is divided into thin rectangular shapes and mounted on a substrate provided with a pixel portion.

REFERENCE

Patent Document

[Patent Document 1] Japanese Published Patent Application No. 2007-286119

[Patent Document 2] Japanese Published Patent Application No. H7-014880

DISCLOSURE OF INVENTION

A driver circuit such as a signal line driver circuit or a scan line driver circuit is required to have not only high operation speed but also high withstand voltage. In particular, in the case of a semiconductor display device in which AC voltage is applied to a pixel, such as a liquid crystal display device, a circuit on an output side of a signal line driver circuit needs to have a withstand voltage of at least approximately more than ten and several volts. Therefore, the structure of a semiconductor element such as a transistor or a capacitor included in the signal line driver circuit needs to be designed so that the above level of withstand voltage is obtained, for example, by increasing the thickness of a gate insulating film and an insulating film interposed between electrodes thereof.

However, not all semiconductor elements included in the signal line driver circuit are required to have the above level of withstand voltage. For example, a circuit distant from the output side of the signal line driver circuit, such as a shift register, only needs to withstand a voltage of approximately 3 V at most. As for a semiconductor element used in the shift register, high-speed operation is more important than high withstand voltage to secure high quality of a display image of the semiconductor display device. In order to realize high-speed operation, it is preferable that the semiconductor element be miniaturized and the thickness of the insulating films thereof be reduced.

However, the same process is employed to manufacture a semiconductor element which needs to have high withstand voltage and a semiconductor element which needs to operate at high speed. It is necessary to employ a complicated process in order to manufacture semiconductor elements having different structures through the same process, which results in a reduction in yield and an increase in cost. Therefore, in practice, the structure of the semiconductor element which needs to operate at high speed has to be designed in accordance with the structure of the semiconductor element which needs to have high withstand voltage. Accordingly, a reduction in the area occupied by the driver circuit is hindered, and it is difficult to secure high operation speed and to suppress power consumption.

In view of the above problems, an object of the present invention is to provide a semiconductor display device including a driver circuit whose high-speed operation and high withstand voltage are secured without making the manufacturing process complicated. Another object of the present invention is to provide a semiconductor display device including a driver circuit whose power consumption is suppressed and whose high withstand voltage is secured without making the manufacturing process complicated. Another object of the present invention is to provide a semiconductor display device including a driver circuit whose occupation area is reduced and whose high withstand voltage is secured without making the manufacturing process complicated.

In order to achieve the above object, in an embodiment of the present invention, a circuit which needs to have high withstand voltage is formed using a semiconductor having a wider bandgap and lower intrinsic carrier density than silicon or germanium. As an example of such a semiconductor, an oxide semiconductor whose bandgap is approximately more than twice as wide as that of silicon can be given. Further, a circuit which does not need to have such high withstand voltage is formed using a crystalline semiconductor including silicon, germanium, or the like. The semiconductor display device is manufactured by connecting the above two circuits.

As semiconductors having a wider bandgap and lower intrinsic carrier density than silicon or germanium, an oxide semiconductor, silicon carbide, gallium nitride, and the like can be given. The bandgap of an oxide semiconductor, the bandgap of silicon carbide, and the bandgap of gallium nitride are 3.0 eV to 3.5 eV, 3.26 eV, and 3.39 eV, respectively, which are approximately three times as wide as that of silicon. The wide bandgaps of these semiconductors are advantageous in terms of improvement in withstand voltage of a semiconductor element such as a transistor, a reduction in loss of power, and the like. According to an embodiment of the present invention, with the use of the above-described semiconductor having a wide bandgap in the circuit which needs to have high withstand voltage, a semiconductor element having resistance to intermediate voltage, that is, intermediate withstand voltage can be manufactured.

According to an embodiment of the present invention, the circuit which does not need to have such high withstand voltage can be formed using a semiconductor and a process different from those of the circuit which needs to have high withstand voltage. Therefore, in the circuit which does not need to have such high withstand voltage, a semiconductor element can be manufactured so as to have resistance to low voltage, that is, low withstand voltage, to operate at high speed, and to be miniaturized with the thickness of an insulating film thereof reduced.

That is, according to an embodiment of the present invention, semiconductor elements having structures most suitable for characteristics needed for circuits can be separately manufactured without making the process complicated.

In this specification, the low voltage means a voltage of lower than or equal to 5 V, preferably lower than or equal to 3 V, further preferably lower than or equal to 1.8 V; the low withstand voltage means resistance to the low voltage. The intermediate voltage means a voltage of higher than 5 V and approximately lower than or equal to 20 V; the intermediate withstand voltage means resistance to the intermediate voltage.

Specifically, in a signal line driver circuit, a circuit that controls the timing of sampling serially input video signals, such as a shift register, needs to have high operation speed rather than high withstand voltage. On the other hand, a circuit that performs signal processing on video signals converted to parallel signals, such as a level shifter, a buffer, or a DA converter (DAC), needs to have high withstand voltage rather than high operation speed. Therefore, in the signal line driver circuit of an embodiment of the present invention, the circuit that controls the timing of sampling video signals has low withstand voltage and the circuit that performs signal processing on video signals converted to parallel signals has intermediate withstand voltage. The signal line driver circuit is formed by connecting the circuit having the low withstand voltage and the circuit having the intermediate withstand voltage.

As for a circuit such as a memory circuit or a sampling circuit, which samples and temporarily holds video signals for conversion of serially input video signals to parallel signals, the level of withstand voltage needed for the circuit is determined as appropriate depending on whether the video signals are analog signals or digital signals. In the case of digital video signals, the withstand voltage of the above circuit is not necessarily high because the circuit needs to operate at high speed owing to an increase in the number of bits. In contrast, in the case of analog video signals, which tend to have higher voltage than digital video signals, the above circuit preferably has the intermediate withstand voltage.

An oxide semiconductor is a metal oxide having semiconductor characteristics, and has mobility approximately as high as microcrystalline or polycrystalline silicon and uniform element characteristics which is a characteristic of amorphous silicon. As the oxide semiconductor, a four-component metal oxide such as an In—Sn—Ga—Zn—O-based oxide semiconductor, a three-component metal oxide such as an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, or a Sn—Al—Zn—O-based oxide semiconductor, a two-component metal oxide such as an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, an In—Mg—O-based oxide semiconductor, or an In—Ga—O-based oxide semiconductor, an In—O-based oxide semiconductor, a Sn—O-based oxide semiconductor, a Zn—O-based oxide semiconductor, or the like can be used. In this specification, for example, an In—Sn—Ga—Zn—O-based oxide semiconductor means a metal oxide including indium (In), tin (Sn), gallium (Ga), and zinc (Zn), and there is no particular limitation on the stoichiometric composition ratio. In addition, the above oxide semiconductor may include silicon.

Moreover, the oxide semiconductor can be represented by the chemical formula, $InMO_3(ZnO)_m$ (m>0, m is not necessarily a natural number). Here, M represents one or more metal elements selected from Ga, Al, Mn, and Co.

With the above structure, according to an embodiment of the present invention, a semiconductor display device including a driver circuit whose high-speed operation and high withstand voltage are secured without making the manufacturing process complicated can be provided. With the above structure, according to an embodiment of the present invention, a semiconductor display device including a driver circuit whose power consumption is suppressed and whose high withstand voltage is secured without making the manufacturing process complicated can be provided. With the above structure, according to an embodiment of the present invention, a semiconductor display device including a driver circuit whose occupation area is reduced and whose high withstand voltage is secured without making the manufacturing process complicated can be provided.

BEST MODE FOR CARRYING OUT THE INVENTION

Embodiments and an example of the present invention will be described below in detail with reference to the accompanying drawings. Note that the present invention is not limited to the following description and it is easily understood by those skilled in the art that the modes and details can be variously changed without departing from the spirit and scope of the present invention. Therefore, the present invention is not construed as being limited to the description of the embodiments and the example below.

The semiconductor display device of the present invention includes the following in its category: liquid crystal display devices, light-emitting devices in which a light-emitting element typified by an organic light-emitting diode (OLED) is provided in each pixel, digital micromirror devices (DMDs), plasma display panels (PDPs), field emission displays (FEDs), and other semiconductor display devices in which a circuit element using a semiconductor film is provided in a driver circuit.

Embodiment 1

Figure 1A:
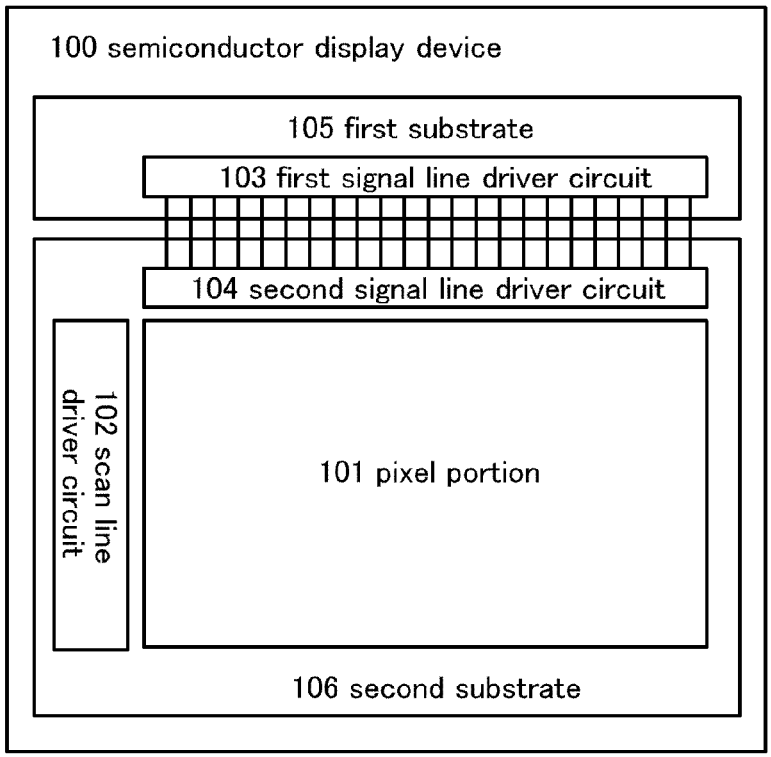
FIG. 1A is a block diagram illustrating a structure of a semiconductor display device.

FIG. 1A is a block diagram illustrating an example of a structure of a semiconductor display device according to an embodiment of the present invention. A semiconductor display device 100 illustrated in FIG. 1A includes a pixel portion 101 where a display element is provided in each pixel, and driver circuits that control the operation of the pixel portion 101.

In FIG. 1A, the driver circuits correspond to a scan line driver circuit 102, a first signal line driver circuit 103, and a second signal line driver circuit 104. Specifically, the scan line driver circuit 102 selects a pixel included in the pixel portion 101. The first signal line driver circuit 103 and the second signal line driver circuit 104 supply a video signal to the pixel selected by the scan line driver circuit 102.

The first signal line driver circuit 103 includes a circuit that controls the timing of sampling serially input video signals and needs to have high operation speed rather than high withstand voltage. On the other hand, the second signal line driver circuit 104 includes a circuit that performs signal processing on video signals converted to parallel signals and needs to have high withstand voltage rather than high operation speed.

In an embodiment of the present invention, the first signal line driver circuit 103 which can operate even with low withstand voltage includes a first semiconductor element manufactured using a crystalline semiconductor such as a polycrystalline or single crystal semiconductor including silicon, germanium, or the like. In addition, the first signal line driver circuit 103 including the first semiconductor element is formed over a first substrate 105 such as a semiconductor substrate or a glass substrate having an insulating surface. The first semiconductor element can operate at high speed by reducing the thickness of an insulating film thereof. Further, the element size of the first semiconductor element can be reduced.

In an embodiment of the present invention, the second signal line driver circuit 104 having intermediate withstand voltage includes a second semiconductor element manufactured using a semiconductor having a wider bandgap and lower intrinsic carrier density than silicon or germanium. With the use of a semiconductor having a wide bandgap, the second semiconductor element can have resistance to intermediate voltage, that is, intermediate withstand voltage. In addition, the second signal line driver circuit 104 including the second semiconductor element is formed over a second substrate 106 such as a glass substrate having an insulating surface.

Note that as examples of a wide-gap semiconductor having a wider bandgap and lower intrinsic carrier density than silicon, a compound semiconductor such as silicon carbide (SiC) or gallium nitride (GaN), an oxide semiconductor including a metal oxide such as zinc oxide (ZnO), and the like can be given. Among them, the oxide semiconductor is advantageous in that it can be formed by a sputtering method or a wet method (such as a printing method) and has high mass productivity. In addition, the oxide semiconductor film can be formed even at room temperature, whereas the process temperature of silicon carbide and the process temperature of gallium nitride are approximately 1500° C. and approximately 1100° C., respectively. Therefore, the oxide semiconductor can be formed over a glass substrate which is inexpensively available and it is possible to stack a semiconductor element formed using an oxide semiconductor over an integrated circuit including a semiconductor which does not have resistance enough to withstand heat treatment at a high temperature of 1500° C. to 2000° C. Furthermore, a larger substrate can be used. Accordingly, among the wide-gap semiconductors, the oxide semiconductor particularly has an advantage of high mass productivity. In addition, in the case where a crystalline oxide semiconductor is to be obtained in order to improve the performance of a transistor (e.g., field-effect mobility), the crystalline oxide semiconductor can be easily obtained by heat treatment at 450° C. to 800° C. (preferably at 250° C. to 800° C.).

In the following description, the case where an oxide semiconductor having the above advantages is used as the semiconductor having a wide bandgap is given as an example.

Note that FIG. 1A illustrates the case where the pixel portion 101 and the scan line driver circuit 102 are formed over the second substrate 106 together with the second signal line driver circuit 104 as an example; however, an embodiment of the present invention is not limited to this structure.

In the case where the first substrate 105 provided with the first signal line driver circuit 103 is a substrate having an insulating surface, the pixel portion 101 may be formed over the first substrate 105 together with the first signal line driver circuit 103. Further, the scan line driver circuit 102 may be formed over the first substrate 105 together with the first signal line driver circuit 103. However, in the case where the pixel portion 101 or the scan line driver circuit 102 operates with intermediate voltage and if a semiconductor element in the pixel portion 101 or the scan line driver circuit 102 can be manufactured using a semiconductor having a wide bandgap in a manner similar to that of the second semiconductor element, the following structure is preferable for security of the withstand voltage of the pixel portion 101 or the scan line driver circuit 102: the pixel portion 101 or the scan line driver circuit 102, and the second signal line driver circuit 104 are formed over the second substrate 106 as illustrated in FIG. 1A.

Further, the first signal line driver circuit 103 and the second signal line driver circuit 104 are connected to each other. There is no particular limitation on the connection method, and a known method such as a chip on glass (COG) method, a wire bonding method, or a tape automated bonding (TAB) method can be used. Alternatively, a chip on film (COF) method, a tape carrier package (TCP) method by which a circuit is mounted on a TAB tape, or the like may be used. Further, a connection position is not limited to the position illustrated in FIG. 1A as long as electrical connection is possible. In addition, a controller, a CPU, a memory, or the like may be formed separately and connected.

Figure 5:
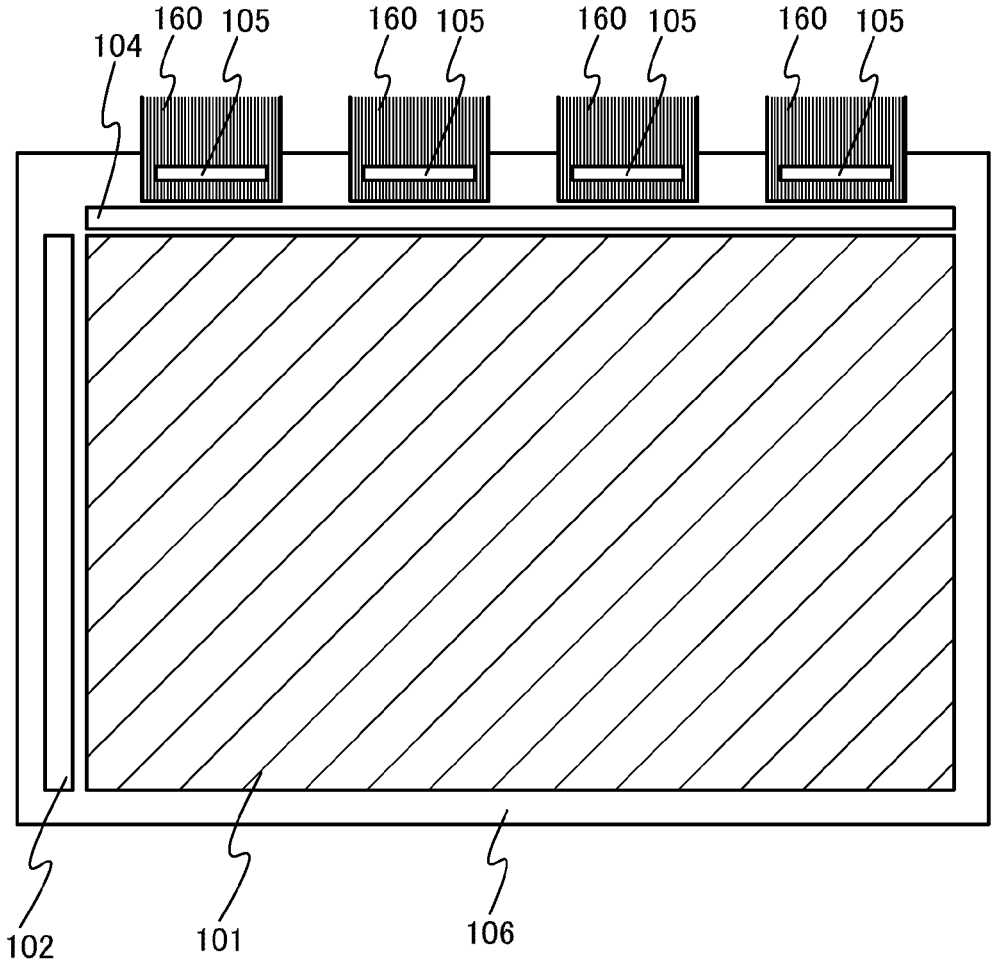
FIG. 5 is an external view of a semiconductor display device.

FIG. 5 is an example of an external view of the semiconductor display device according to an embodiment of the present invention. In the semiconductor display device in FIG. 5, the first substrate 105 provided with the first signal line driver circuit 103 is mounted on a TAB tape 160 as an example. In the semiconductor display device in FIG. 5, the pixel portion 101, the scan line driver circuit 102, and the second signal line driver circuit 104 are formed over the second substrate 106. Further, through the TAB tape 160, the first signal line driver circuit 103 formed over the first substrate 105 is connected to the second signal line driver circuit 104 formed over the second substrate 106.

Note that the semiconductor display device of an embodiment of the present invention includes, in its category, a panel in which driver circuits such as the first signal line driver circuit 103, the second signal line driver circuit 104, and the scan line driver circuit 102 are connected to the pixel portion 101; and a module in which an IC including a controller, a CPU, a memory, or the like is mounted on the panel.

Figure 1B:
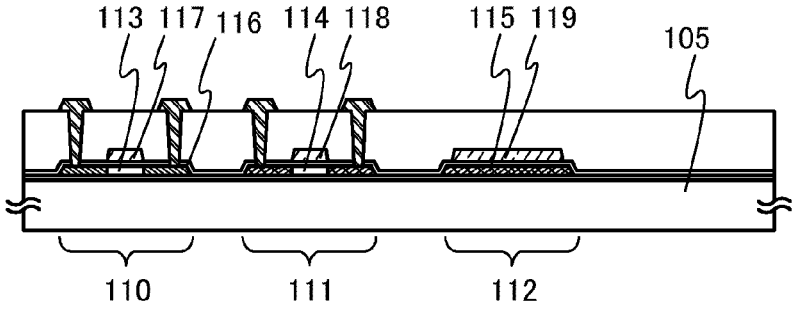
FIGS. 1B and 1C are cross-sectional views of semiconductor elements.

Next, an example of a cross section of the first semiconductor element in the case where the first substrate 105 is a substrate having an insulating surface is illustrated in FIG. 1B. FIG. 1B illustrates an example in which an n-channel transistor 110, a p-channel transistor 111, and a capacitor 112 are manufactured over the first substrate 105 as the first semiconductor elements.

The transistor 110 includes a semiconductor film 113 which is a polycrystalline or single crystal semiconductor film including silicon or germanium, an insulating film 116 over the semiconductor film 113, and a gate electrode 117 which overlaps with the semiconductor film 113 with the insulating film 116 positioned therebetween. The transistor 111 includes a semiconductor film 114 which is a polycrystalline or single crystal semiconductor film including silicon or germanium, the insulating film 116 over the semiconductor film 114, and a gate electrode 118 which overlaps with the semiconductor film 114 with the insulating film 116 positioned therebetween. The capacitor 112 includes a semiconductor film 115 which is a polycrystalline or single crystal semiconductor film including silicon or germanium, the insulating film 116 over the semiconductor film 115, and an electrode 119 which overlaps with the semiconductor film 115 with the insulating film 116 positioned therebetween.

In the case where the semiconductor film 114 is formed using single crystal silicon and the insulating film 116 is formed using silicon oxide, for example, the thickness of the insulating film 116 is preferably greater than or equal to 1 nm and less than or equal to 20 nm, further preferably greater than or equal to 5 nm and less than or equal to 10 nm.

Note that the structures of the first semiconductor elements are not limited to those illustrated in FIG. 1B. The first semiconductor elements can be manufactured using a semiconductor film or the like formed over a silicon wafer, a silicon-on-insulator (SOI) substrate, or an insulating surface.

An SOI substrate can be manufactured using, for example, UNIBOND (registered trademark) typified by Smart Cut (registered trademark), epitaxial layer transfer (ELTRAN) (registered trademark), a dielectric separation method, plasma assisted chemical etching (PACE), separation by implanted oxygen (SIMOX), or the like.

A semiconductor film of silicon formed over a substrate having an insulating surface may be crystallized by a known technique. As the known technique of crystallization, a laser crystallization method using a laser beam and a crystallization method using a catalytic element are given. Alternatively, a crystallization method using a catalytic element and a laser crystallization method may be combined. In the case of using a substrate having high heat resistance such as a quartz substrate, any of the following crystallization methods may be combined: a thermal crystallization method using an electrically heated oven, a lamp annealing crystallization method using infrared light, a crystallization method using a catalytic element, and a high temperature annealing method at approximately 950° C.

The first semiconductor elements manufactured by the above method may be transferred to a separately prepared first substrate having flexibility such as a plastic substrate. The semiconductor elements can be transferred to another substrate by a variety of methods. Examples of the transfer method include a method in which a metal oxide film is provided between the substrate and the semiconductor element, and the metal oxide film is embrittled by crystallization so that the semiconductor element is separated off and transferred; a method in which an amorphous silicon film including hydrogen is provided between the substrate and the semiconductor element, and the amorphous silicon film is removed by laser beam irradiation or etching so that the semiconductor element is separated off from the substrate and transferred; and a method in which the substrate provided with the semiconductor element is removed by mechanical cutting or etching using a solution or a gas so that the semiconductor element is cut off from the substrate and transferred.

Figure 1C:
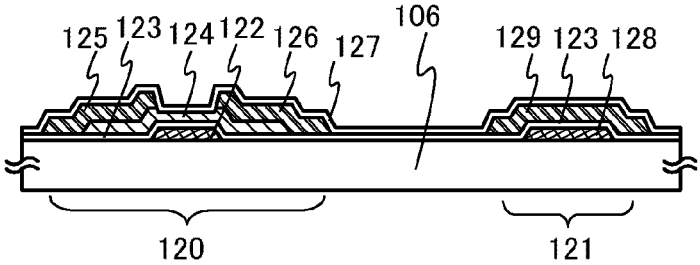

FIG. 1C illustrates an example of a cross section of the second semiconductor element. FIG. 1C illustrates an example in which a transistor 120 and a capacitor 121 are manufactured over the second substrate 106 as the second semiconductor elements.

The transistor 120 includes a gate electrode 122, an insulating film 123 over the gate electrode 122, an active layer 124 which includes an oxide semiconductor and overlaps with the gate electrode 122 with the insulating film 123 positioned therebetween, and a source electrode 125 and a drain electrode 126 over the active layer 124. The transistor 120 may further include an insulating film 127 which covers the active layer 124, the source electrode 125, and the drain electrode 126. FIG. 1C illustrates the case where the transistor 120 is a bottom-gate transistor and has a channel-etched structure in which part of the active layer 124 is etched between the source electrode 125 and the drain electrode 126, as an example.

The capacitor 121 includes an electrode 128, the insulating film 123 over the electrode 128, and an electrode 129 which overlaps with the electrode 128 with the insulating film 123 positioned therebetween.

Note that the semiconductor element means a circuit element including a semiconductor film and includes, in its category, any circuit element such as a diode, a resistor, and an inductor in addition to a transistor and a capacitor described above.

In the case where the insulating film 123 is formed using silicon oxide, for example, the thickness of the insulating film 123 is preferably greater than or equal to 50 nm and less than or equal to 400 nm, further preferably greater than or equal to 100 nm and less than or equal to 200 nm.

Figure 2:
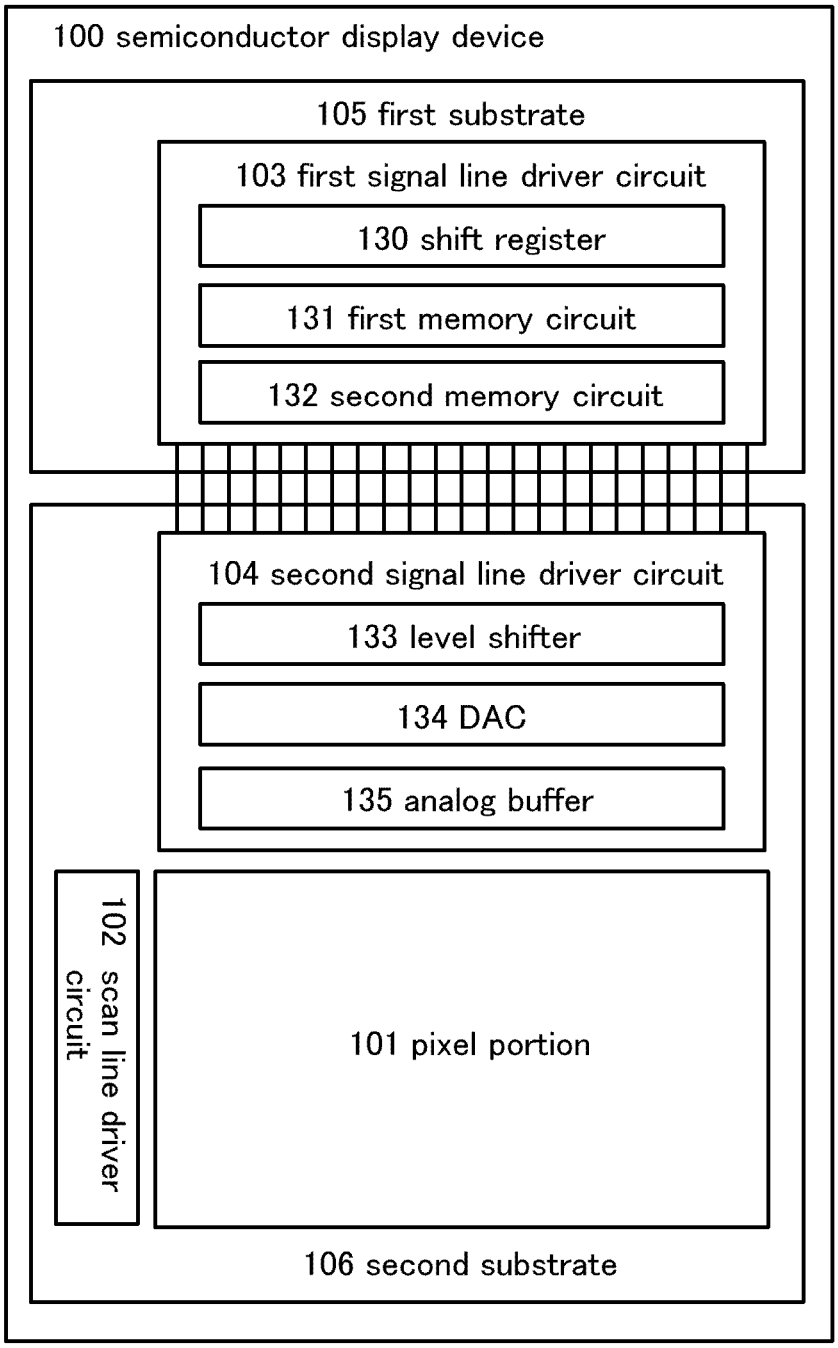
FIG. 2 is a block diagram illustrating a structure of a semiconductor display device.

Next, FIG. 2 illustrates an example of a more specific structure of the semiconductor display device 100 illustrated in FIG. 1A. In the semiconductor display device 100 illustrated in FIG. 2, the first signal line driver circuit 103 includes a shift register 130, a first memory circuit 131, and a second memory circuit 132. The second signal line driver circuit 104 includes a level shifter 133, a DAC 134, and an analog buffer 135.

Figure 3:
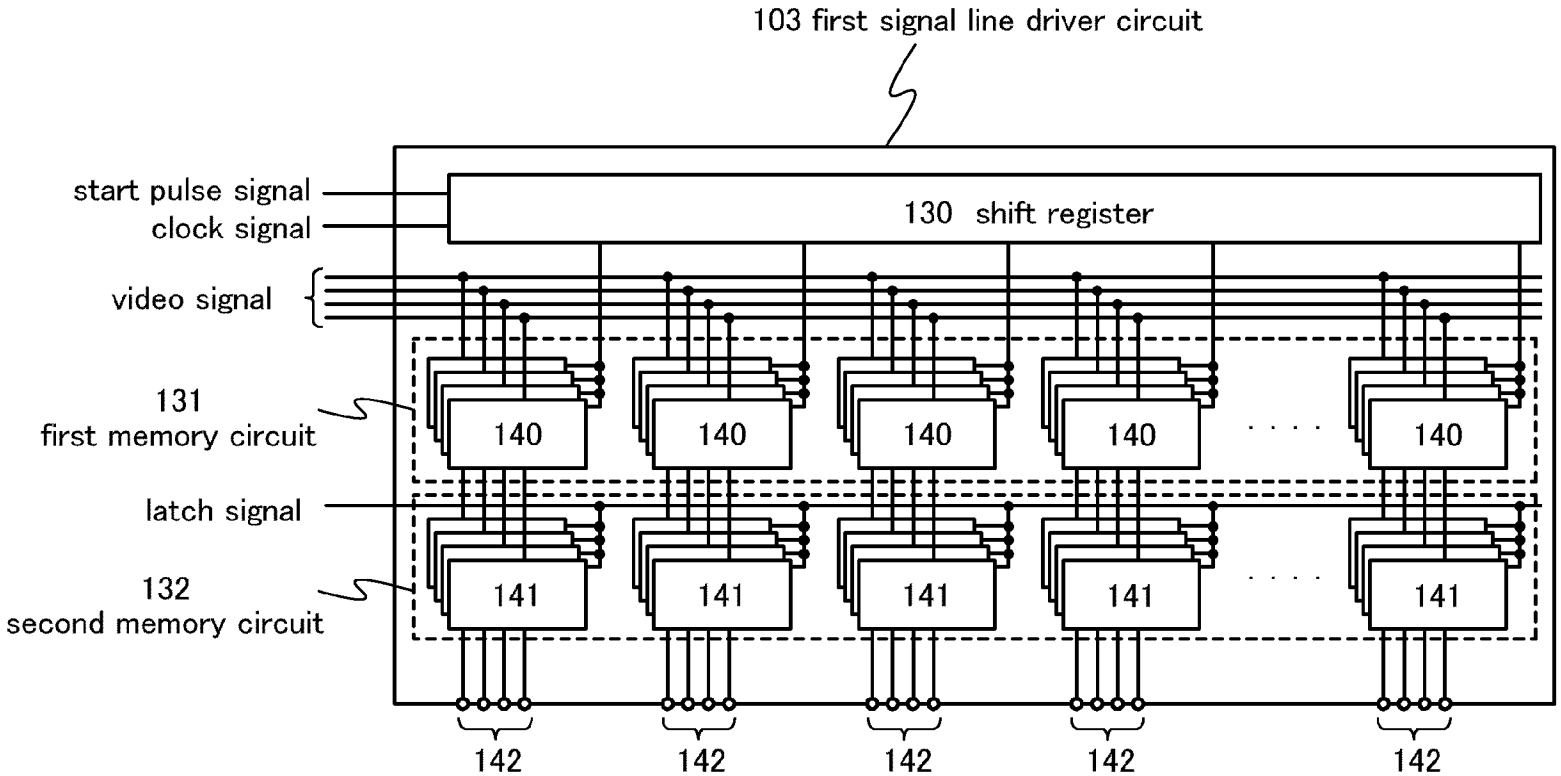
FIG. 3 is a diagram illustrating a structure of a first signal line driver circuit.
Figure 4:
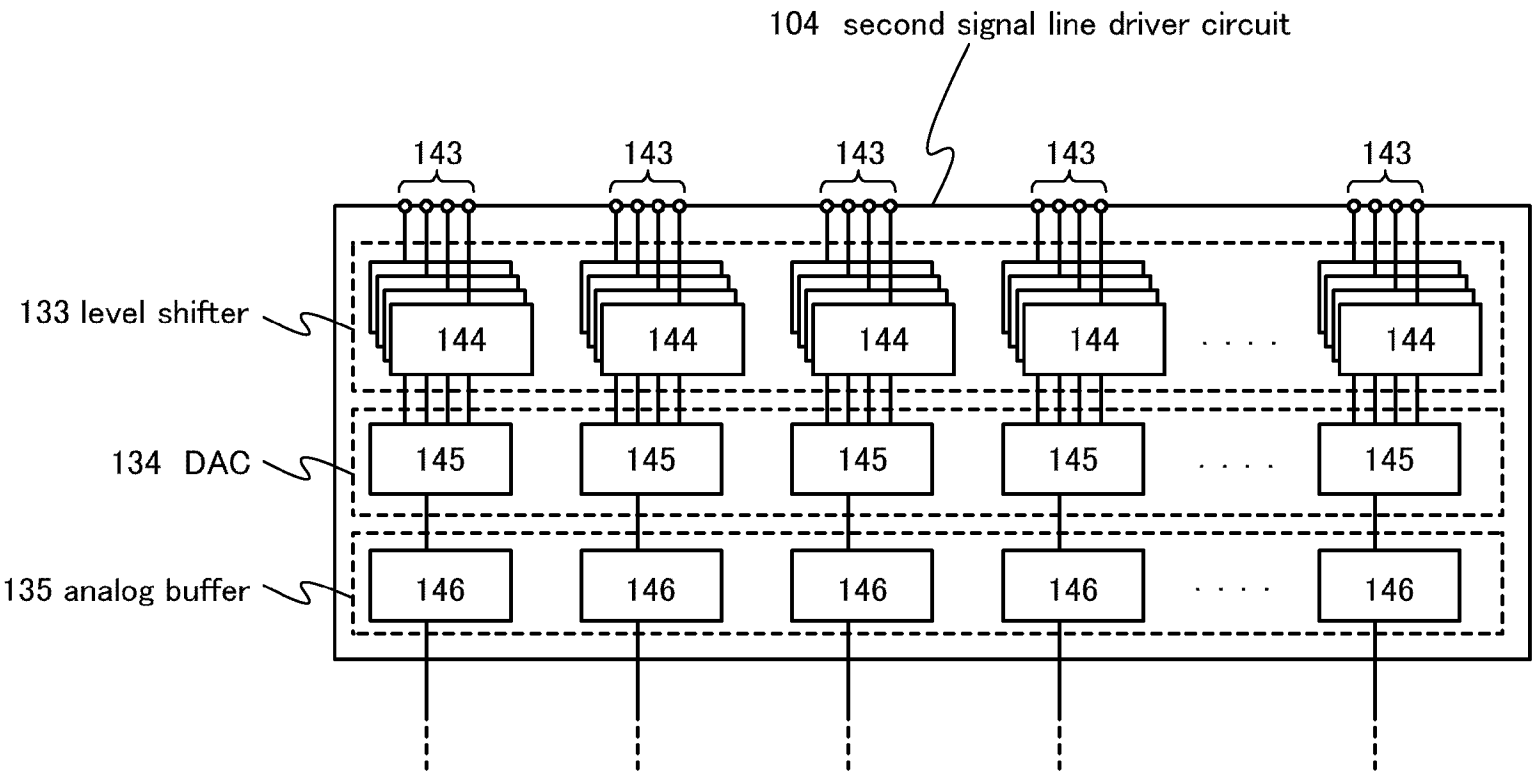
FIG. 4 is a diagram illustrating a structure of a second signal line driver circuit.

FIG. 3 illustrates an example of a more specific structure of the first signal line driver circuit 103 illustrated in FIG. 2. FIG. 4 illustrates an example of a more specific structure of the second signal line driver circuit 104 illustrated in FIG. 2. Note that FIG. 3 and FIG. 4 illustrate the structures of the first signal line driver circuit 103 and the second signal line driver circuit 104, respectively, with which a 4-bit video signal is applied. In this embodiment, the first signal line driver circuit and the second signal line driver circuit each have a structure with which a 4-bit video signal can be applied as an example; however, the present invention is not limited to this structure. The first signal line driver circuit and the second signal line driver circuit can be formed in accordance with the number of bits of a video signal set by a practitioner.

In the first signal line driver circuit 103 in FIG. 3, the first memory circuit 131 includes a plurality of memory element groups each having four memory elements 140 corresponding to the each of the 4-bit signal. The second memory circuit 132 includes a plurality of memory element groups each having four memory elements 141 corresponding to the each of the 4-bit signal. The video signal output from the second memory circuit 132 is supplied to a plurality of terminals 142.

In the second signal line driver circuit 104 in FIG. 4, the video signal supplied to a plurality of terminals 143 is supplied to the level shifter 133. The level shifter 133 includes a plurality of level shifter groups each having four level shifters 144 corresponding to the each of the 4-bit signal. The DAC 134 includes a plurality of DACs 145 corresponding to the 4-bit video signal. The analog buffer 135 includes a plurality of buffers 146, and at least one of the buffers 146 corresponds to one DAC 145.

Next, operation of the semiconductor display device 100 illustrated in FIG. 2, FIG. 3, and FIG. 4 will be described. In the first signal line driver circuit 103, a clock signal and a start pulse signal are input to the shift register 130. The shift register 130 generates timing signals, pulses of which are sequentially shifted, in response to the clock signal and the start pulse signal, and outputs the timing signals to the first memory circuit 131. The order of the appearance of the pulses of the timing signals can be switched in accordance with a scan direction switching signal.

When the timing signal is input to the first memory circuit 131, video signals are sampled in accordance with the pulses of the timing signals, and are sequentially written to the memory elements 140 of the first memory circuit 131. In other words, the video signals which are serially input to the first signal line driver circuit 103 are written in parallel to the first memory circuit 131. The video signals written to the first memory circuit 131 are held.

The video signals may be sequentially written to the plurality of memory elements 140 included in the first memory circuit 131; alternatively, a so-called division driving may be performed in which the plurality of memory elements 140 included in the first memory circuit 131 is divided into some groups, and the video signals are input to each group in parallel. Note that the number of memory elements included in each group in this case is referred to as the number of divisions. For example, in the case where the memory elements are divided into groups such that each group has four memory elements 140, division driving is performed with four divisions.

The time until the completion of writing of the video signal to the first memory circuit 131 is referred to as a line period.

When one line period is completed, in a retrace period, the video signals held in the first memory circuit 131 are written to the second memory circuit 132 all at once and held in accordance with a pulse of a latch signal input to the second memory circuit 132. Video signals for the next line period are sequentially written to the first memory circuit 131 which has finished transmitting the video signals to the second memory circuit 132, in response to timing signals from the shift register 130. In the second round of the one line period, the video signals written to and held in the second memory circuit 132 are output from the terminal 142 of the first signal line driver circuit 103 and supplied to the terminal 143 of the second signal line driver circuit 104.

In the second signal line driver circuit 104, the voltage amplitude of the video signals from the first signal line driver circuit 103 is increased in each of the plurality of level shifters 144 in the level shifter 133, and then transmitted to the DAC 134. In the DAC 134, the input video signals are converted from digital signals to analog signals in each of the plurality of DACs 145. Then, the analog video signals are transmitted to the analog buffer 135. The video signals transmitted from the DAC 134 are transmitted from each of the plurality of buffers 146 included in the analog buffer 135 to the pixel portion 101 through signal lines.

In the scan line driver circuit 102, selection of pixels included in the pixel portion 101 is performed for each line. The video signals transmitted from the second signal line driver circuit 104 to the pixel portion 101 through the signal lines are input to pixels in a line selected by the scan line driver circuit 102.

Note that another circuit which can output signals of which pulses are sequentially shifted may be used instead of the shift register 130.

In the semiconductor display device 100 illustrated in FIG. 2, FIG. 3, and FIG. 4, the withstand voltage of the shift register 130, the first memory circuit 131, and the second memory circuit 132 included in the first signal line driver circuit 103 is not necessarily high. In order to secure a high-quality display image on the pixel portion 101, it is more important for the shift register 130, the first memory circuit 131, and the second memory circuit 132 to have high operation speed than to have high withstand voltage. On the other hand, the level shifter 133, the DAC 134, and the analog buffer 135 included in the second signal line driver circuit 104 have intermediate withstand voltage.

According to an embodiment of the present invention, in the first signal line driver circuit 103 which does not need to have such high withstand voltage can be formed using a semiconductor and a process different from those of the second signal line driver circuit 104 which needs to have high withstand voltage. Thus, since the thickness of an insulating film in the first signal line driver circuit 103 which does not need to have such high withstand voltage can be made smaller than that in the second signal line driver circuit 104, the first signal line driver circuit 103 can operate at high speed and the first semiconductor element can be miniaturized. Moreover, in the second signal line driver circuit 104 which needs to have high withstand voltage, the thickness of an insulating film is made larger than that in the first signal line driver circuit 103; thus, the second semiconductor element can have high withstand voltage. That is, according to an embodiment of the present invention, semiconductor elements having structures most suitable for characteristics needed for circuits can be separately manufactured without making the process complicated.

In this manner, according to an embodiment of the present invention, a semiconductor display device including a driver circuit whose high-speed operation and high withstand voltage are secured without making the manufacturing process complicated can be provided. According to an embodiment of the present invention, a semiconductor display device including a driver circuit whose power consumption is suppressed and whose high withstand voltage is secured without making the manufacturing process complicated can be provided. According to an embodiment of the present invention, a semiconductor display device including a driver circuit whose occupation area is reduced and whose high withstand voltage is secured without making the manufacturing process complicated can be provided.

Embodiment 2

In this embodiment, specific configurations of a level shifter, a DAC, and a buffer used in a second signal line driver circuit will be described.

Figure 6:
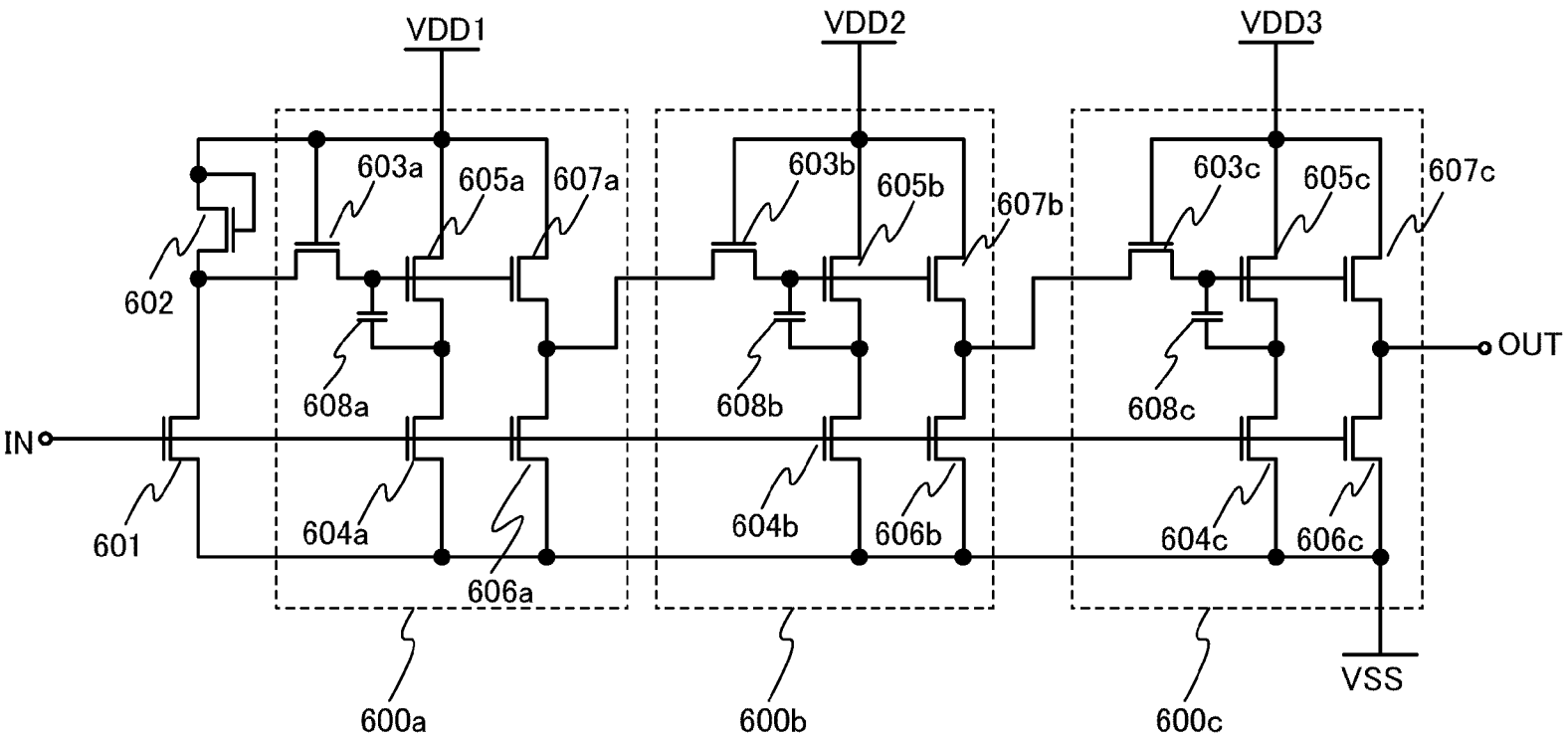
FIG. 6 is a circuit diagram of a level shifter.

FIG. 6 illustrates an example of a level shifter including an n-channel transistor. The level shifter illustrated in FIG. 6 includes a bootstrap circuit as a base. Specifically, the level shifter illustrated in FIG. 6 includes bootstrap circuits 600*a* to 600*c*, a transistor 601, and a transistor 602.

A drain electrode and a gate electrode of the transistor 602 are connected to a node supplied with a high-level power supply potential VDD1, and a source electrode of the transistor 602 is connected to a drain electrode of the transistor 601. A potential of an input signal IN to be input to the level shifter is supplied to a gate electrode of the transistor 601, and a source electrode of the transistor 601 is connected to a node supplied with a low-level power supply potential VSS.

The bootstrap circuit 600*a* includes a transistor 603*a*, a transistor 604*a*, a transistor 605*a*, a transistor 606*a*, a transistor 607*a*, and a capacitor 608*a*. A gate electrode of the transistor 603*a* is connected to the node supplied with the power supply potential VDD1, a source electrode of the transistor 603*a* is connected to the source electrode of the transistor 602, and a drain electrode of the transistor 603*a* is connected to a gate electrode of the transistor 605*a*. A gate electrode of the transistor 604*a* is connected to the gate electrode of the transistor 601, a drain electrode of the transistor 604*a* is connected to a source electrode of the transistor 605*a*, and a source electrode of the transistor 604*a* is connected to the node supplied with the power supply potential VSS. A drain electrode of the transistor 605*a* is connected to the node supplied with the power supply potential VDD1. A gate electrode of the transistor 606*a* is connected to the gate electrode of the transistor 604*a*, and a drain electrode of the transistor 606*a* is connected to a source electrode of the transistor 607*a*, and a source electrode of the transistor 606*a* is connected to the node supplied with the power supply potential VSS. A gate electrode of the transistor 607*a* is connected to the gate electrode of the transistor 605*a*, and a drain electrode of the transistor 607*a* is connected to the node supplied with the power supply potential VDD1. One electrode of the capacitor 608*a* is connected to the gate electrode of the transistor 605*a*, and the other electrode of the capacitor 608*a* is connected to the source electrode of the transistor 605*a*.

The bootstrap circuit 600*b* includes a transistor 603*b*, a transistor 604*b*, a transistor 605*b*, a transistor 606*b*, a transistor 607*b*, and a capacitor 608*b*. The bootstrap circuit 600*c* includes a transistor 603*c*, a transistor 604*c*, a transistor 605*c*, a transistor 606*c*, a transistor 607*c*, and a capacitor 608*c*.

The connection relation of the semiconductor elements included in the bootstrap circuit 600*b* and the bootstrap circuit 600*c* is similar to that in the bootstrap circuit 600*a*. That is, the transistor 603*a* corresponds to the transistor 603*b* and the transistor 603*c*, the transistor 604*a* corresponds to the transistor 604*b* and the transistor 604*c*, the transistor 605*a* corresponds to the transistor 605*b* and the transistor 605*c*, the transistor 606*a* corresponds to the transistor 606*b* and the transistor 606*c*, the transistor 607*a* corresponds to the transistor 607*b* and the transistor 607*c*, and the capacitor 608*a* corresponds to the capacitor 608*b* and the capacitor 608*c*. Note that a source electrode of the transistor 603*b* is connected to the source electrode of the transistor 607*a* and the drain electrode of the transistor 606*a*. A source electrode of the transistor 603*c* is connected to a source electrode of the transistor 607*b* and a drain electrode of the transistor 606*b*. In the bootstrap circuit 600*b*, a node supplied with a high-level power supply potential VDD2 is used instead of the node supplied with the power supply potential VDD1. In the bootstrap circuit 600*c*, a node supplied with a high-level power supply potential VDD3 is used instead of the node supplied with the power supply potential VDD1. The potential of a source electrode of the transistor 607*c* and a drain electrode of the transistor 606*c* is output as an output signal OUT of the level shifter.

The terms "source electrode" and "drain electrode" included in a transistor interchange with each other depending on the polarity of the transistor or the levels of potentials supplied to the respective electrodes. In general, in an n-channel transistor, an electrode to which a lower potential is supplied is called a source electrode, and an electrode to which a higher potential is supplied is called a drain electrode. Further, in a p-channel transistor, an electrode to which a lower potential is supplied is called a drain electrode, and an electrode to which a higher potential is supplied is called a source electrode. In this specification, for convenience, the connection relation of the transistor is described assuming that the source electrode and the drain electrode are fixed in some cases; actually, the names of the source electrode and the drain electrode interchange with each other depending on the relation between the potentials.

Note that the term "connection" in this specification means electrical connection and corresponds to the state in which current, voltage, or potential can be supplied, applied, or conducted. Accordingly, a connection state means not only a state of direct connection but also a state of indirect connection through a circuit element such as a wiring, a resistor, a diode, or a transistor so that current, voltage, or potential can be supplied, applied, or conducted.

In this specification, even when a circuit diagram illustrates independent components connected to each other, there is a case where one conductive film has functions of a plurality of components such as the case where part of a wiring also functions as an electrode. The term "connection" also means such a case where one conductive film has functions of a plurality of components.

Next, operation of the level shifter illustrated in FIG. 6 will be described.

When the potential of the input signal IN is set to a high level, the transistors 601, 604*a*, 606*a*, 604*b*, 606*b*, 604*c*, and 606*c* are turned on. In addition, the low-level power supply potential VSS is supplied to the source electrodes of the transistors 601, 604*a*, and 606*a*. Thus, the transistor 603*a* is turned on, so that the low-level power supply potential VSS is supplied to the drain electrode of the transistor 603*a* and the transistors 605*a* and 607*a* are turned off. Accordingly, the low-level power supply potential VSS is supplied to the source electrode of the transistor 603*b* through the transistor 606*a*. Since the high-level power supply potential VDD2 is supplied to a gate electrode of the transistor 603*b*, the transistor 603*b* is turned on when the power supply potential VSS is supplied to the source electrode thereof. Thus, the low-level power supply potential VSS is supplied to a drain electrode of the transistor 603*b*, so that the transistors 605*b* and 607*b* are turned off. Accordingly, the low-level power supply potential VSS is supplied to the source electrode of the transistor 603*c* through the transistor 606*b*. Since the high-level power supply potential VDD3 is supplied to a gate electrode of the transistor 603*c*, the transistor 603*c* is turned on when the power supply potential VSS is supplied to the source electrode thereof. Thus, the low-level power supply potential VSS is supplied to a drain electrode of the transistor 603*c*, so that the transistors 605*c* and 607*c* are turned off. Then, the low-level power supply potential VSS is supplied to the source electrode of the transistor 607*c* through the transistor 606*c*, and this potential is output as the output signal OUT.

Next, when the potential of the input signal IN is set to a low level, the transistors 601, 604*a*, 606*a*, 604*b*, 606*b*, 604*c*, and 606*c* are turned off. Since the high-level power supply potential VDD1 is supplied to the source electrode of the transistor 603*a* through the transistor 602, the potential of the drain electrode of the transistor 603*a* is raised. Thus, the transistors 605*a* and 607*a* are turned on. Then, the transistor 603*a* is turned off since a gate voltage thereof is lower than a threshold voltage thereof. Current flows through the transistor 605*a* and the potential of the source electrode thereof is raised. Since the capacitor 608*a* is connected between the source electrode and the gate electrode of the transistor 605*a*, the potential of the gate electrode of the transistor 605*a* is raised along with the potential of the source electrode thereof and becomes higher than the power supply potential VDD1. Similarly, the potential of the source electrode of the transistor 607*a* is raised to the level of the power supply potential VDD1.

Since the high-level power supply potential VDD1 is supplied to the source electrode of the transistor 603*b* through the transistor 607*a*, the potential of the drain electrode of the transistor 603*b* is raised. Thus, the transistors 605*b* and 607*b* are turned on. Then, the transistor 603*b* is turned off since a gate voltage thereof is lower than a threshold voltage thereof. Current flows through the transistor 605*b* and the potential of the source electrode thereof is raised. Since the capacitor 608*b* is connected between the source electrode and a gate electrode of the transistor 605*b*, the potential of the gate electrode of the transistor 605*b* is raised along with the potential of the source electrode thereof and becomes higher than the power supply potential VDD2. Similarly, the potential of the source electrode of the transistor 607*b* is raised to the level of the power supply potential VDD2.

Since the high-level power supply potential VDD2 is supplied to the source electrode of the transistor 603*c* through the transistor 607*b*, the potential of the drain electrode of the transistor 603*c* is raised. Thus, the transistors 605*c* and 607*c* are turned on. Then, the transistor 603*c* is turned off since a gate voltage thereof is lower than a threshold voltage thereof. Current flows through the transistor 605*c* and the potential of the source electrode thereof is raised. Since the capacitor 608*c* is connected between the source electrode and a gate electrode of the transistor 605*c*, the potential of the gate electrode of the transistor 605*c* is raised along with the potential of the source electrode thereof and becomes higher than the power supply potential VDD3. Similarly, the potential of the source electrode of the transistor 607*c* is raised to the level of the power supply potential VDD3. Accordingly, the potential of the output signal OUT is the power supply potential VDD3.

The power supply potential VDD1 is set to the same level as a power supply potential of a first signal line driver circuit having low withstand voltage, the power supply potential VDD3 is set to the same level as a power supply potential supplied to the buffer, and the power supply potential VDD2 is set to a level between the power supply potential VDD1 and the power supply potential VDD3; thus, the level can be shifted so that the amplitude of the output signal OUT is increased.

The configuration and operation of the level shifter described above are examples, and an embodiment of the present invention is not limited to the above description.

Figure 7:
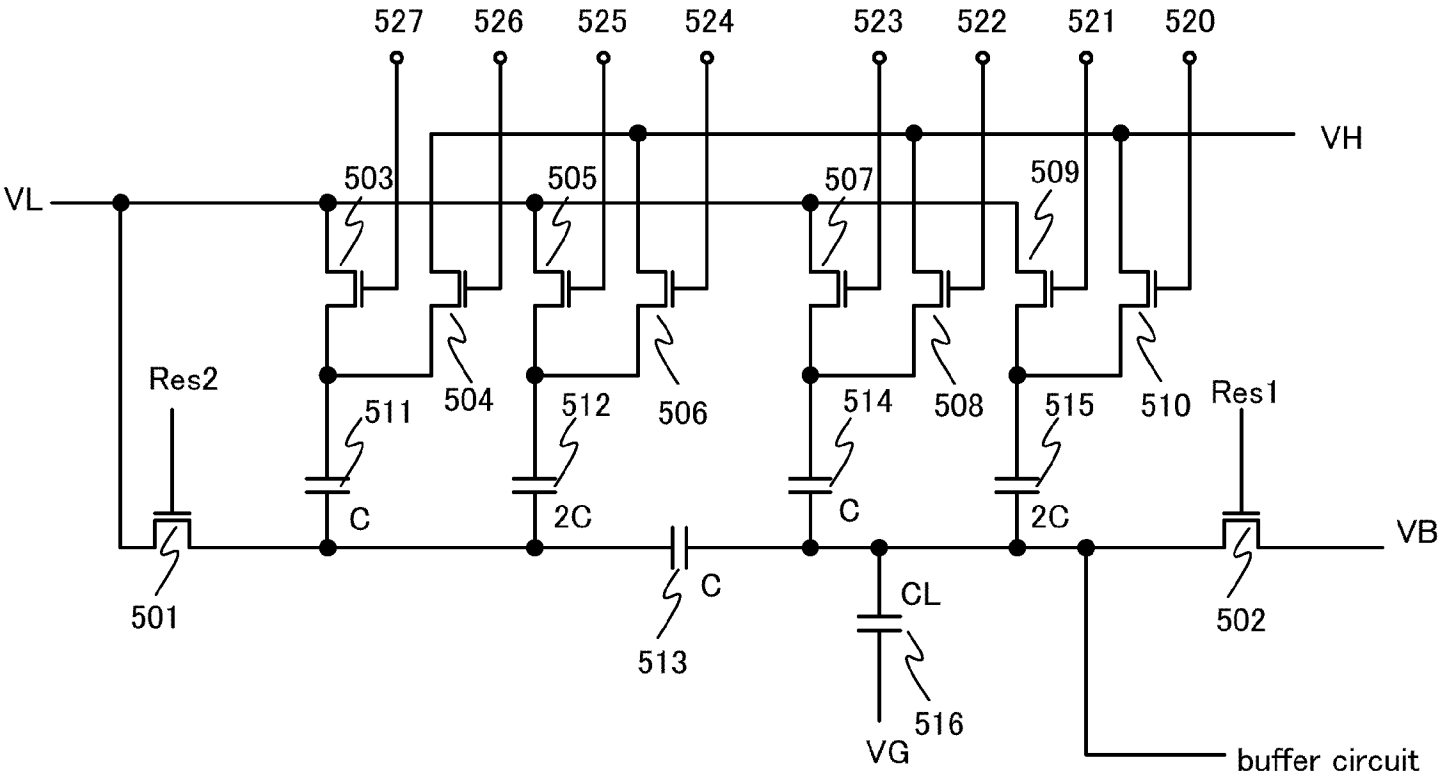
FIG. 7 is a circuit diagram of a DAC.

Next, FIG. 7 illustrates an example of a DAC including an n-channel transistor. The DAC illustrated in FIG. 7 is a CDAC including transistors 501 to 510 which function as switching elements and capacitors 511 to 516. In this embodiment, the DAC has a structure with which a 4-bit video signal can be applied as an example; however, an embodiment of the present invention is not limited to this structure. The DAC can be formed in accordance with the number of bits of a video signal set by a practitioner.

The transistors 501 and 502 function as switching elements for initializing the amount of electric charge accumulated in the capacitors 511 to 516. The transistors 503 to 510 function as switching elements for controlling supply of power supply potentials to the capacitors 511 to 516.

Specifically, a gate electrode of the transistor 503 is connected to a terminal 527, a source electrode of the transistor 503 is connected to one electrode of the capacitor 511, and a drain electrode of the transistor 503 is connected to a node supplied with a power supply potential VL. A gate electrode of the transistor 504 is connected to a terminal 526, a source electrode of the transistor 504 is connected to the one electrode of the capacitor 511, and a drain electrode of the transistor 504 is connected to a node supplied with a power supply potential VH. A gate electrode of the transistor 505 is connected to a terminal 525, a source electrode of the transistor 505 is connected to one electrode of the capacitor 512, and a drain electrode of the transistor 505 is connected to the node supplied with the power supply potential VL. A gate electrode of the transistor 506 is connected to a terminal 524, a source electrode of the transistor 506 is connected to the one electrode of the capacitor 512, and a drain electrode of the transistor 506 is connected to the node supplied with the power supply potential VH. A gate electrode of the transistor 507 is connected to a terminal 523, a source electrode of the transistor 507 is connected to one electrode of the capacitor 514, and a drain electrode of the transistor 507 is connected to the node supplied with the power supply potential VL. A gate electrode of the transistor 508 is connected to a terminal 522, a source electrode of the transistor 508 is connected to the one electrode of the capacitor 514, and a drain electrode of the transistor 508 is connected to the node supplied with the power supply potential VH. A gate electrode of the transistor 509 is connected to a terminal 521, a source electrode of the transistor 509 is connected to one electrode of the capacitor 515, and a drain electrode of the transistor 509 is connected to the node supplied with the power supply potential VL. A gate electrode of the transistor 510 is connected to a terminal 520, a source electrode of the transistor 510 is connected to the one electrode of the capacitor 515, and a drain electrode of the transistor 510 is connected to the node supplied with the power supply potential VH.

A gate electrode of the transistor 501 is connected to a terminal Res2, a source electrode of the transistor 501 is connected to the node supplied with the power supply potential VL, and a drain electrode of the transistor 501 is connected to the other electrode of the capacitor 511, the other electrode of the capacitor 512, and one electrode of the capacitor 513. A gate electrode of the transistor 502 is connected to a terminal Rest, a source electrode of the transistor 502 is connected to a node supplied with a power supply potential VB, and a drain electrode of the transistor 502 is connected to the other electrode of the capacitor 513, the other electrode of the capacitor 514, the other electrode of the capacitor 515, and one electrode of the capacitor 516. The other electrode of the capacitor 516 is supplied with a power supply potential VG. Thus, the potential of the drain electrode of the transistor 502 is output as an output signal.

Next, operation of the DAC illustrated in FIG. 7 will be described.

Firstly, initialization is performed. In the initialization, high-level potentials are supplied to the terminal Res1, the terminal Res2, the terminal 521, the terminal 523, the terminal 525, and the terminal 527, so that the transistors 501, 502, 503, 505, 507, and 509 are turned on. Low-level potentials are supplied to the terminal 520, the terminal 522, the terminal 524, and the terminal 526, so that the transistors 504, 506, 508, and 510 are turned off. Accordingly, the power supply potential VL is supplied to both of the pairs of electrodes of the capacitors 511 and 512; a potential difference between the power supply potential VL and the power supply potential VB is applied between the electrodes of the capacitors 513, 514, and 515; and a potential difference between the power supply potential VB and the power supply potential VG is applied between the electrodes of the capacitor 516.

Next, digital-analog conversion is performed. First, low-level potentials are supplied to the terminal Res1 and the terminal Res2, so that the transistors 501 and 502 are turned off. Then, potentials of the corresponding bits of the video signal are supplied to the terminals 520 to 527. Specifically, a potential of a first bit is supplied to the terminal 520, and a potential with an inverted phase thereof is supplied to the terminal 521. A potential of a second bit is supplied to the terminal 522, and a potential with an inverted phase thereof is supplied to the terminal 523. A potential of a third bit is supplied to the terminal 524, and a potential with an inverted phase thereof is supplied to the terminal 525. A potential of a fourth bit is supplied to the terminal 526, and a potential with an inverted phase thereof is supplied to the terminal 527.

Thus, switching of the transistors 503 to 510 is controlled in accordance with the potentials of the corresponding bits of the video signal. Then, the power supply potential VL or the power supply potential VH is supplied to the one electrodes of the capacitors 511, 512, 514, and 515 through the transistors that are turned on among the transistors 503 to 510. With the above configuration, the capacitors 511 to 516 are charged with and discharged of electric charge in accordance with the potentials of the corresponding bits of the video signal, and then get into a steady state. After that, the potential of the drain electrode of the transistor 502 is determined by the amount of electric charge and the capacitance of the capacitors 511 to 516, and is output from the DAC as a potential of the output signal.

The configuration and operation of the DAC described above are examples, and an embodiment of the present invention is not limited to the above description.

Figure 8:
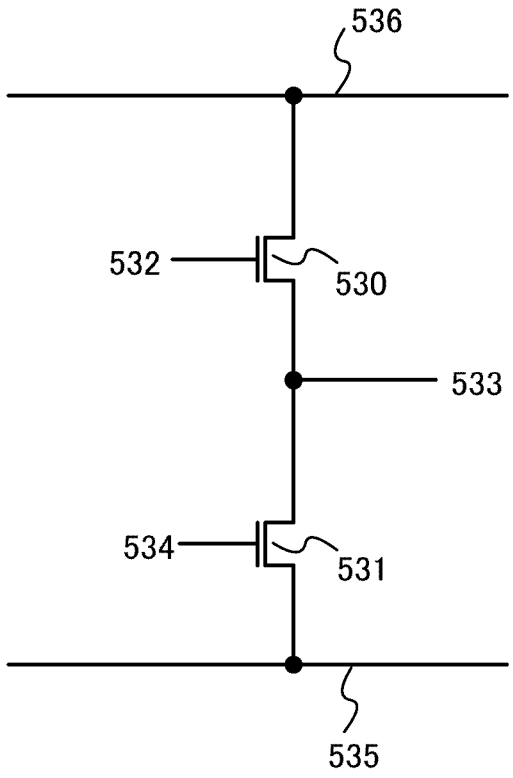
FIG. 8 is a circuit diagram of a buffer.

Next, FIG. 8 illustrates an example of a buffer including an n-channel transistor. The buffer illustrated in FIG. 8 is a source follower circuit including a transistor 530 and a transistor 531.

Specifically, a gate electrode of the transistor 530 is connected to a terminal 532, a source electrode of the transistor 530 is connected to a terminal 533, and a drain electrode of the transistor 530 is connected to a node 536 supplied with a high-level power supply potential. A gate electrode of the transistor 531 is connected to a terminal 534, a source electrode of the transistor 531 is connected to a node 535 supplied with a low-level power supply potential, and a drain electrode of the transistor 531 is connected to the terminal 533.

The output signal of the DAC is supplied to the terminal 532. Further, the terminal 533 is connected to a signal line extended to a pixel portion. The operation of the transistor 531 is controlled by a potential supplied to the terminal 534 so that constant drain current is obtained, and the transistor 531 functions as a constant current source. Note that the above drain current does not necessarily flow constantly, and the current flow may be stopped when there is no change in the potential of the signal line.

The configuration and operation of the buffer described above are examples, and an embodiment of the present invention is not limited to the above description.

This embodiment can be implemented in combination with the above embodiment as appropriate.

Embodiment 3

In this embodiment, a specific structure of a pixel portion will be described by taking a liquid crystal display device which is one of semiconductor display devices of the present invention as an example.

Figure 9:
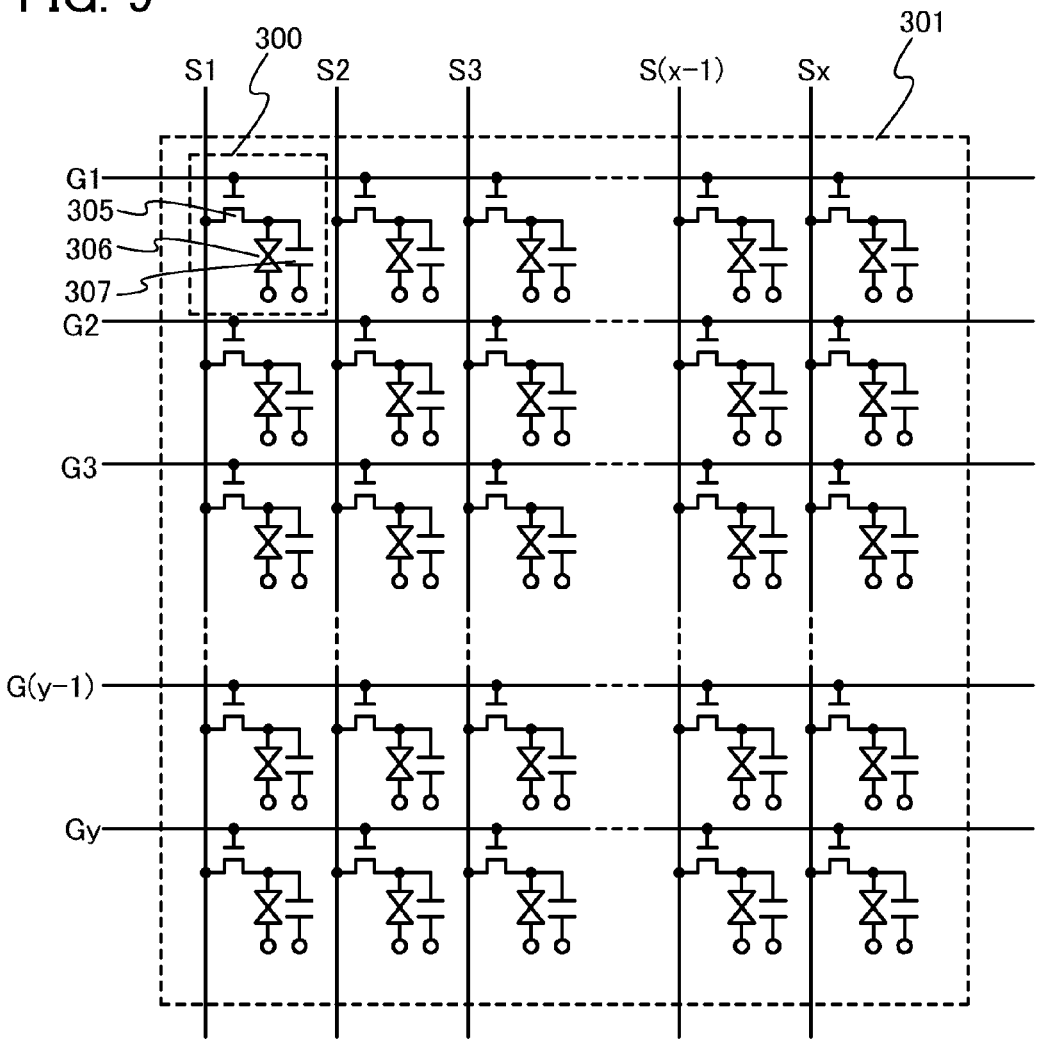
FIG. 9 is a circuit diagram illustrating a configuration of a pixel portion.

FIG. 9 illustrates a configuration of a pixel portion 301 including a plurality of pixels 300, as an example. In FIG. 9, each of the pixels 300 includes at least one of signal lines S1 to Sx and at least one of scan lines G1 to Gy. In addition, the pixel 300 includes a transistor 305 which functions as a switching element, a liquid crystal element 306, and a capacitor 307. The liquid crystal element 306 includes a pixel electrode, a counter electrode, and liquid crystals to which voltage between the pixel electrode and the counter electrode is applied.

The transistor 305 controls whether a potential of the signal line, that is, a potential of a video signal is supplied to the pixel electrode of the liquid crystal element 306. A predetermined potential is supplied to the counter electrode of the liquid crystal element 306. In addition, the capacitor 307 includes a pair of electrodes; one electrode (first electrode) is connected to the pixel electrode of the liquid crystal element 306, and a predetermined potential is supplied to the other electrode (second electrode).

Note that FIG. 9 illustrates the case where one transistor 305 is used as a switching element in the pixel 300; an embodiment of the present invention is not limited to this structure. A plurality of transistors may be used as switching elements.

Next, operation of the pixel portion 301 illustrated in FIG. 9 will be described.

First, when the scan lines G1 to Gy are sequentially selected, the transistors 305 in the pixels 300 including the selected scan lines are turned on. Then, when a potential of the video signal is supplied to the signal lines S1 to Sx, the potential of the video signal is supplied to the pixel electrodes of the liquid crystal elements 306 through the transistors 305 which are turned on, respectively.

In the liquid crystal element 306, the alignment of liquid crystal molecules is changed in accordance with the level of the voltage applied between the pixel electrode and the counter electrode, whereby transmittance is changed. Consequently, the transmittance of the liquid crystal element 306 is controlled by the potential of the video signal, so that grayscale display can be performed.

Next, when the selection of the scan lines is completed, the transistors 305 are turned off in the pixels 300 including the selected scan lines. The liquid crystal element 306 holds the voltage applied between the pixel electrode and the counter electrode, whereby the grayscale display is maintained.

In the liquid crystal display device, so-called AC driving in which the polarity of voltage applied to the liquid crystal element 306 is inverted at a predetermined timing is performed in order to prevent deterioration of the liquid crystals called burn-in. Specifically, AC driving can be performed in such a manner that the polarity of the potential of the video signal input to each of the pixels 300 is inverted with the use of the potential of the counter electrode as a reference. Further, change in the potential supplied to the signal line is increased by the AC driving; thus, a potential difference between a source electrode and a drain electrode of the transistor 305 which functions as a switching element is increased. Accordingly, deterioration of characteristics such as a shift in threshold voltage is easily caused in the transistor 305. Furthermore, in order to maintain the voltage held in the liquid crystal element 306, the transistor 305 needs to have low off-state current even when the potential difference between the source electrode and the drain electrode is large.

Unless otherwise specified, in the case of an n-channel transistor, off-state current in this specification is current which flows between a source electrode and a drain electrode when a potential of the drain electrode is higher than that of the source electrode and that of a gate electrode while the potential of the gate electrode is less than or equal to zero when a reference potential is the potential of the source electrode. Alternatively, in the case of a p-channel transistor, off-state current in this specification is current which flows between a source electrode and a drain electrode when a potential of the drain electrode is lower than that of the source electrode and that of a gate electrode while the potential of the gate electrode is greater than or equal to zero when a reference potential is the potential of the source electrode.

In an embodiment of the present invention, a semiconductor such as an oxide semiconductor having a wider bandgap and lower intrinsic carrier density than silicon or germanium is used for the transistor 305, whereby the withstand voltage of the transistor 305 can be increased.

Further, an oxide semiconductor (purified OS) purified by reduction of impurities such as moisture or hydrogen which serves as an electron donor (donor) is an intrinsic (i-type) semiconductor or a substantially i-type semiconductor. Therefore, use of the above oxide semiconductor for the transistor 305 enables the off-state current of the transistor 305 to be significantly reduced.

Specifically, the hydrogen concentration of the purified oxide semiconductor, which is measured by secondary ion mass spectrometry (SIMS), is lower than or equal to $5\times10^{19}/cm^3$, preferably lower than or equal to $5\times10^{18}/cm^3$, further preferably lower than or equal to $5\times10^{17}/cm^3$, still further preferably less than $1\times10^{16}/cm^3$. In addition, the carrier density of the oxide semiconductor film, which can be measured by Hall effect measurement, is lower than $1\times10^{14}/cm^3$, preferably lower than $1\times10^{12}/cm^3$, further preferably lower than $1\times10^{11}/cm^3$. Furthermore, the bandgap of the oxide semiconductor is greater than or equal to 2 eV, preferably greater than or equal to 2.5 eV, further preferably greater than or equal to 3 eV. With the use of the oxide semiconductor film which is purified by sufficiently reducing the concentration of impurities such as moisture or hydrogen, off-state current of the transistor can be reduced.

The analysis of the hydrogen concentration of the oxide semiconductor film is described here. The hydrogen concentrations of the oxide semiconductor film and a conductive film are measured by SIMS. It is known that it is difficult to obtain accurate data in the proximity of a surface of a sample or in the proximity of an interface between stacked films formed using different materials by the SIMS in principle. Thus, in the case where distribution of the hydrogen concentration of the film in a thickness direction is analyzed by SIMS, an average value in a region where the film is provided, the value is not greatly changed, and almost the same value can be obtained is employed as the hydrogen concentration. Further, in the case where the thickness of the film is small, a region where almost the same value is obtained cannot be found in some cases owing to the influence of the hydrogen concentration of an adjacent film. In this case, the maximum value or the minimum value of the hydrogen concentration of a region where the film is provided is employed as the hydrogen concentration of the film. Furthermore, in the case where a mountain-shaped peak having the maximum value and a valley-shaped peak having the minimum value do not exist in the region where the film is provided, the value of the inflection point is employed as the hydrogen concentration.

Various experiments can actually prove low off-state current of the transistor including the purified oxide semiconductor film as an active layer. For example, even an element having a channel width of $1\times10^6$ μm and a channel length of 10 μm can have the characteristic of an off-state current (drain current in the case where voltage between a gate electrode and a source electrode is 0 V or less) of less than or equal to the measurement limit of a semiconductor parameter analyzer, that is, less than or equal to $1\times10^{-13}$ A, in a range of 1 V to 10 V of voltage (drain voltage) between the source electrode and a drain electrode. In this case, it can be found that off-state current density corresponding to a value obtained by dividing the off-state current by the channel width of the transistor is less than or equal to 100 zA/μm. In addition, in an experiment, a circuit where a capacitor is connected to a transistor (whose gate insulating film has a thickness of 100 nm) and electric charge flowing in or out of the capacitor is controlled by the transistor was used. When a purified oxide semiconductor film is used for a channel formation region of the transistor, the off-state current density of the transistor was measured on the basis of change in the amount of electric charge in the capacitor per unit time. It was found that a lower off-state current density of 10 zA/μm to 100 zA/μm was obtained in the case where the voltage between the source electrode and the drain electrode of the transistor was 3 V. Therefore, the off-state current density of the transistor including the purified oxide semiconductor film as an active layer can be lower than or equal to 10 zA/μm, preferably lower than or equal to 1 zA/μm, further preferably lower than or equal to 1 yA/μm, depending on the voltage between the source electrode and the drain electrode. Accordingly, the transistor including the purified oxide semiconductor film as an active layer has much lower off-state current than a transistor including crystalline silicon.

In addition, a transistor including a purified oxide semiconductor shows almost no temperature dependence of off-state current. This is because the conductivity type is made to be as close to an intrinsic type as possible by removing impurities serving as electron donors (donors) in the oxide semiconductor to purify the oxide semiconductor, so that the Fermi level is located in a center of the forbidden band. This also results from the fact that the oxide semiconductor has an energy gap of 3 eV or more and includes extremely few thermally excited carriers. In addition, the source electrode and the drain electrode are in a degenerated state, which is also a factor for showing no temperature dependence. The transistor is mostly operated by carriers injected into the oxide semiconductor from the degenerated source electrode and the carrier density has no dependence on temperature; therefore, the off-state current has no dependence on temperature.

By increasing the withstand voltage of the transistor 305, reliability of the liquid crystal display device can be increased. Moreover, by reducing the off-state current of the transistor 305, change in transmittance in the liquid crystal display device can be prevented from being recognized.

This embodiment can be implemented in combination with any of the above embodiments as appropriate.

Embodiment 4

In this embodiment, an example in which the semiconductor display device 100 has a structure different from that in FIG. 2 will be described.

Figure 10:
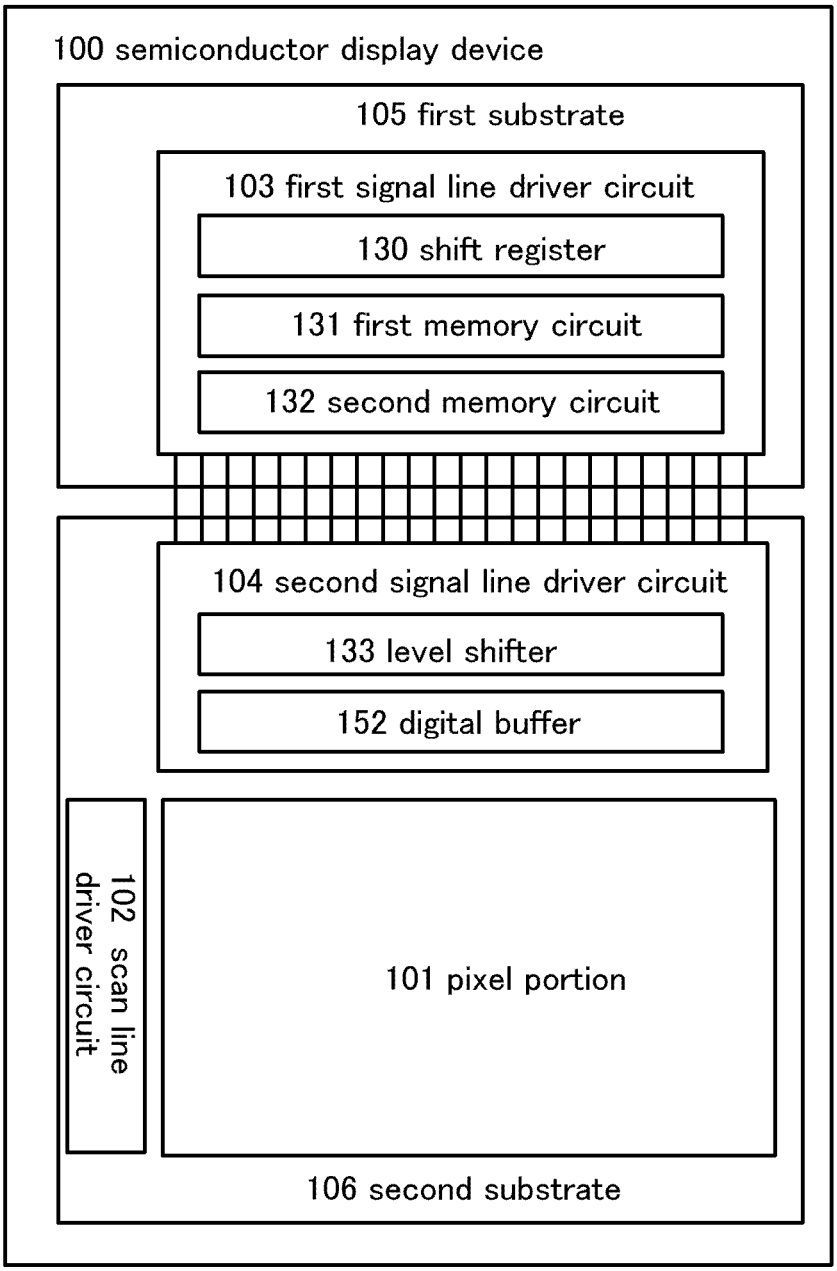
FIG. 10 is a block diagram illustrating a structure of a semiconductor display device.

FIG. 10 illustrates an example of a structure of the semiconductor display device 100 of an embodiment of the present invention. In the semiconductor display device 100 illustrated in FIG. 10, the first signal line driver circuit 103 includes the shift register 130, the first memory circuit 131, and the second memory circuit 132 as in the case of FIG. 2. In the semiconductor display device 100 illustrated in FIG. 10, the second signal line driver circuit 104 does not include the DAC 134 and the analog buffer 135 and includes a level shifter 133 and a digital buffer 152, which is different from the case of FIG. 2.

Next, operation of the semiconductor display device 100 illustrated in FIG. 10 will be described. The operation of the first signal line driver circuit 103 is similar to that in the case of FIG. 2 and thus the description in Embodiment 1 can be referred to. Note that in FIG. 10, a video signal written to and held in the second memory circuit 132 is output from the first signal line driver circuit 103 and transmitted to the level shifter 133 in the second signal line driver circuit 104. The level shifter 133 increases the voltage amplitude of the input video signal and outputs the increased signal. The video signal output from the level shifter 133 is transmitted from the digital buffer 152 to the pixel portion 101 through a signal line.

In the scan line driver circuit 102, selection of pixels included in the pixel portion 101 is performed for each line. The video signal transmitted from the second signal line driver circuit 104 to the pixel portion 101 through the signal line is input to pixels in a line selected by the scan line driver circuit 102.

Note that another circuit which can output a signal of which pulse is sequentially shifted may be used instead of the shift register 130.

In the semiconductor display device 100 illustrated in FIG. 10, not an analog video signal but a digital video signal is input to the pixel portion 101. Therefore, grayscale display can be performed in the pixel portion 101 by an area ratio grayscale method or a time ratio grayscale method, for example. An area ratio grayscale method is a driving method in which one pixel is divided into a plurality of subpixels and the subpixels are driven on the basis of corresponding bits of a video signal so that grayscale display is performed. Further, a time ratio grayscale method is a driving method in which the ratio of periods during which a pixel displays a bright image and a dark image is controlled so that grayscale display is performed.

In the semiconductor display device 100 illustrated in FIG. 10, the withstand voltage of the shift register 130, the first memory circuit 131, and the second memory circuit 132 included in the first signal line driver circuit 103 is not necessarily high. In order to secure a high-quality display image on the pixel portion 101, it is more important for the shift register 130, the first memory circuit 131, and the second memory circuit 132 to have high operation speed than to have high withstand voltage. On the other hand, the level shifter 133 and the digital buffer 152 included in the second signal line driver circuit 104 have intermediate withstand voltage.

Figure 11:
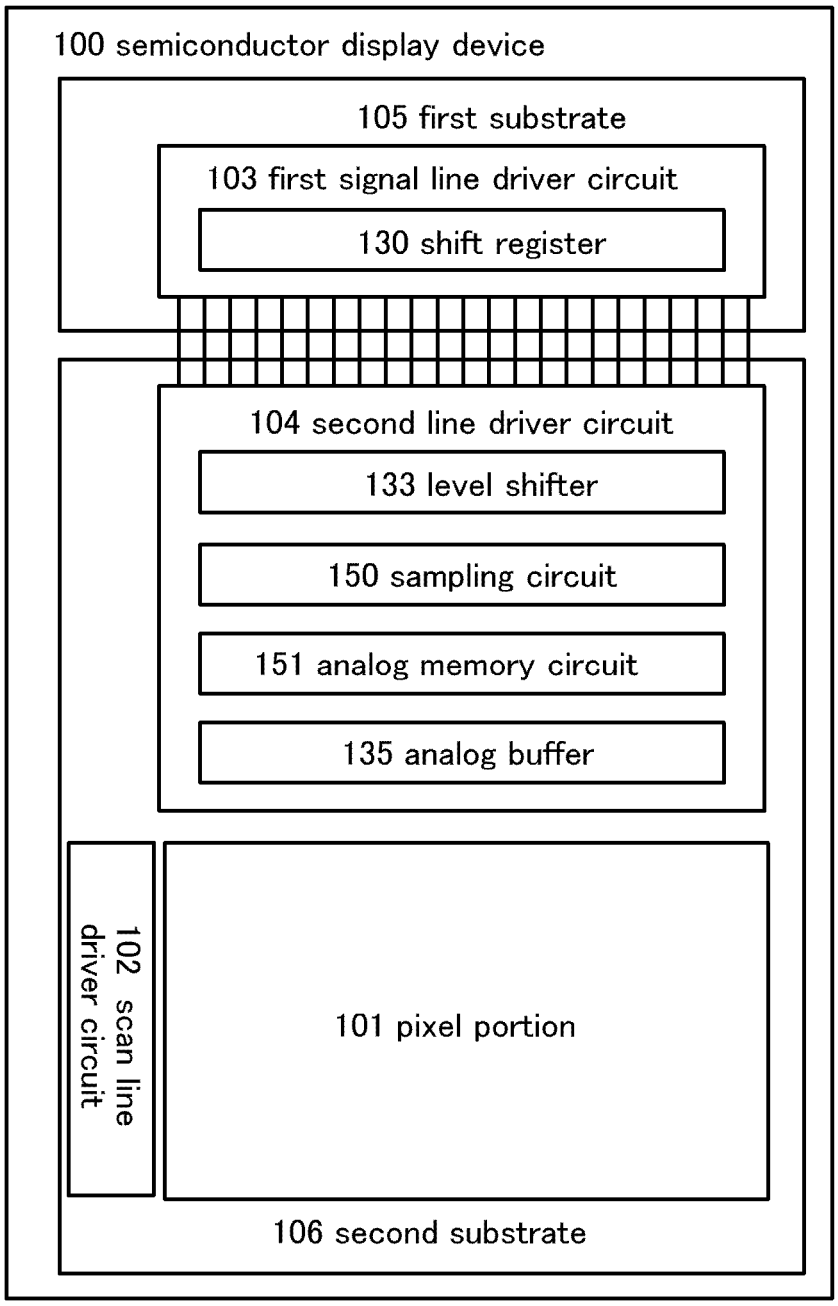
FIG. 11 is a block diagram illustrating a structure of a semiconductor display device.

FIG. 11 illustrates another example of a structure of the semiconductor display device 100 of an embodiment of the present invention. In the semiconductor display device 100 illustrated in FIG. 11, the first signal line driver circuit 103 does not include the first memory circuit 131 and the second memory circuit 132 and includes the shift register 130, which is different from the case of FIG. 2. Further, in the semiconductor display device 100 illustrated in FIG. 11, the second signal line driver circuit 104 includes a sampling circuit 150 and an analog memory circuit 151 instead of the DAC 134, which is different from the case of FIG. 2.

Next, operation of the semiconductor display device 100 illustrated in FIG. 11 will be described. In the first signal line driver circuit 103, a clock signal and a start pulse signal are input to the shift register 130. The shift register 130 generates a timing signal, a pulse of which is sequentially shifted, in response to the clock signal and the start pulse signal, and outputs the timing signal. The order of the appearance of the pulse of the timing signal can be switched in accordance with a scan direction switching signal.

Then, the voltage amplitude of the timing signal output from the first signal line driver circuit 103 is increased in the level shifter 133 of the second signal line driver circuit 104, and then the timing signal is transmitted to the sampling circuit 150. In the sampling circuit 150, an analog video signal is sampled in accordance with the input timing signal. In other words, the video signals serially input to the second signal line driver circuit 104 are written in parallel by the sampling circuit 150. The video signals written by the sampling circuit 150 are held. When all video signals for one line period are sampled, the sampled video signals are output to the analog memory circuit 151 all at once and held in accordance with a latch signal. The video signals held in the analog memory circuit 151 are input from the analog buffer 135 to the pixel portion 101 through signal lines.

Note that in this embodiment, an example in which the video signals for one line period are sampled in the sampling circuit 150, and then all the sampled video signals are input to the analog memory circuit 151 in a lower stage all at once is described; however, an embodiment of the present invention is not limited to this structure. In the sampling circuit 150, every time a video signal for each pixel is sampled, the sampled video signal may be input to the signal line, without waiting for the one line period to finish.

In addition, video signals may be sampled sequentially in corresponding pixels, or so-called division driving in which pixels in one line are divided into several groups and video signals are sampled in each pixel in one group at the same time may be performed.

Then, when the video signals are input to the pixel portion 101 from the analog memory circuit 151, the sampling circuit 150 can sample video signals for the next line period at the same time.

In the scan line driver circuit 102, selection of pixels included in the pixel portion 101 is performed for each line. The video signals transmitted from the second signal line driver circuit 104 to the pixel portion 101 through the signal lines are input to pixels in a line selected by the scan line driver circuit 102.

Note that another circuit which can output a signal of which pulse is sequentially shifted may be used instead of the shift register 130.

In the semiconductor display device 100 illustrated in FIG. 11, an analog video signal is input to the pixel portion 101. Therefore, grayscale display can be performed in the pixel portion 101 in a manner similar to that in the case of FIG. 2.

In the semiconductor display device 100 illustrated in FIG. 11, the withstand voltage of the shift register 130 included in the first signal line driver circuit 103 is not necessarily high. In order to secure a high-quality display image on the pixel portion 101, it is more important for the shift register 130 to have high operation speed than to have high withstand voltage. On the other hand, the level shifter 133, the sampling circuit 150, the analog memory circuit 151, and the analog buffer 135 included in the second signal line driver circuit 104 have intermediate withstand voltage.

According to an embodiment of the present invention, in the first signal line driver circuit 103 which does not need to have such high withstand voltage can be formed using a semiconductor and a process different from those of the second signal line driver circuit 104 which needs to have high withstand voltage. Thus, since the thickness of an insulating film in the first signal line driver circuit 103 which does not need to have such high withstand voltage can be made smaller than that in the second signal line driver circuit 104, the first signal line driver circuit 103 can operate at high speed and a first semiconductor element can be miniaturized. Moreover, in the second signal line driver circuit 104 which needs to have high withstand voltage, the thickness of an insulating film is made larger than that in the first signal line driver circuit 103; thus, a second semiconductor element can have high withstand voltage. That is, according to an embodiment of the present invention, semiconductor elements having structures most suitable for characteristics needed for circuits can be separately manufactured without making the process complicated.

According to an embodiment of the present invention, a semiconductor display device including a driver circuit whose high-speed operation and high withstand voltage are secured without making the manufacturing process complicated can be provided. According to an embodiment of the present invention, a semiconductor display device including a driver circuit whose power consumption is suppressed and whose high withstand voltage is secured without making the manufacturing process complicated can be provided. According to an embodiment of the present invention, a semiconductor display device including a driver circuit whose occupation area is reduced and whose high withstand voltage is secured without making the manufacturing process complicated can be provided.

This embodiment can be implemented in combination with any of the above embodiments as appropriate.

Embodiment 5

In this embodiment, structures of second semiconductor elements, which are different from those in FIG. 1C, will be described.

Figure 12A:
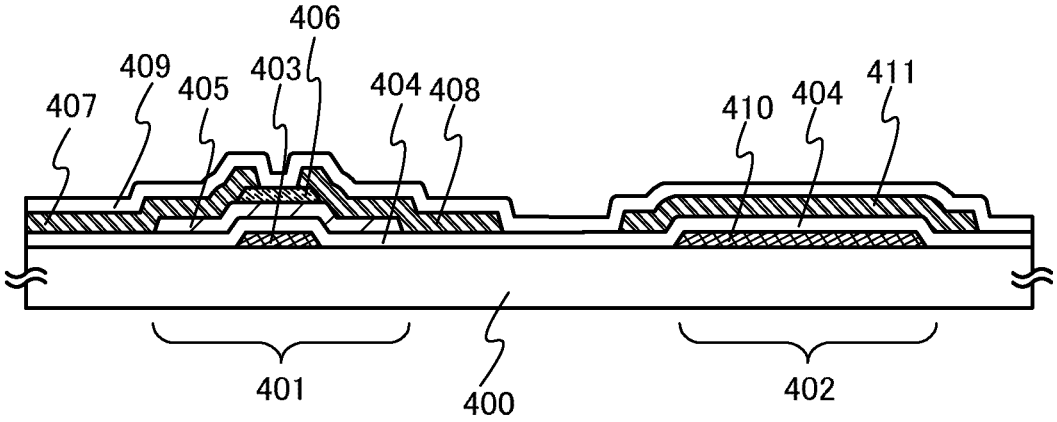
FIGS. 12A to 12C are cross-sectional views of semiconductor elements.

FIG. 12A illustrates an example in which a transistor 401 and a capacitor 402 which are second semiconductor elements are formed over a second substrate 400.

The transistor 401 includes, over the second substrate 400 having an insulating surface, a gate electrode 403, an insulating film 404 over the gate electrode 403, an oxide semiconductor film 405 which overlaps with the gate electrode 403 with the insulating film 404 positioned therebetween and functions as an active layer, a channel protective film 406 over the oxide semiconductor film 405, and a source electrode 407 and a drain electrode 408 over the oxide semiconductor film 405. An insulating film 409 is formed over the oxide semiconductor film 405, the channel protective film 406, the source electrode 407, and the drain electrode 408, and the transistor 401 may include the insulating film 409 as a component.

Further, the capacitor 402 includes an electrode 410, the insulating film 404 over the electrode 410, and an electrode 411 over the insulating film 404.

The channel protective film 406 can be formed by a vapor deposition method such as a plasma CVD method or a thermal CVD method, or a sputtering method. In addition, the channel protective film 406 is preferably formed using an inorganic material including oxygen (such as silicon oxide, silicon oxynitride, or silicon nitride oxide). An inorganic material including oxygen is used for the channel protective film 406, whereby a structure can be provided in which oxygen is supplied to at least a region of the oxide semiconductor film 405 in contact with the channel protective film 406 and oxygen deficiency serving as a donor is reduced to satisfy the stoichiometric composition ratio even when the oxygen deficiency is caused by heat treatment for reducing moisture or hydrogen in the oxide semiconductor film 405. Therefore, a channel formation region can be made i-type or substantially i-type, and variation in electric characteristics of the transistor 401 caused by oxygen deficiency is reduced; accordingly, the electric characteristics can be improved.

Note that a channel formation region corresponds to a region of a semiconductor film, which overlaps with a gate electrode with a gate insulating film positioned therebetween.

The transistor 401 may further include a back-gate electrode over the insulating film 409. The back-gate electrode is formed so as to overlap with the channel formation region of the oxide semiconductor film 405. The back-gate electrode may be electrically insulated and in a floating state, or may be in a state where the back-gate electrode is supplied with a potential. In the latter case, the back-gate electrode may be supplied with a potential at the same level as the gate electrode 403, or may be supplied with a fixed potential such as a ground potential. By controlling the level of the potential supplied to the back-gate electrode, it is possible to control the threshold voltage of the transistor 401.

Figure 12B:
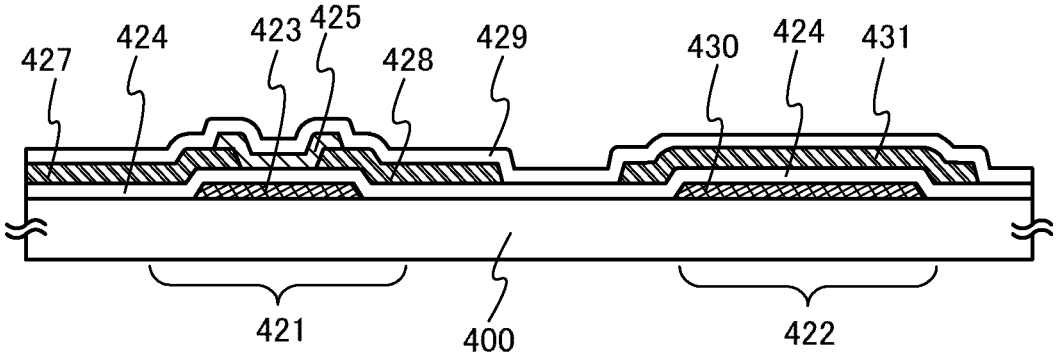

FIG. 12B illustrates an example in which a transistor 421 and a capacitor 422 which are second semiconductor elements and have structures different from those in FIG. 12A are formed over the second substrate 400.

The transistor 421 includes, over the second substrate 400 having an insulating surface, a gate electrode 423, an insulating film 424 over the gate electrode 423, a source electrode 427 and a drain electrode 428 over the insulating film 424, and an oxide semiconductor film 425 which overlaps with the gate electrode 423 with the insulating film 424 positioned therebetween, is in contact with the source electrode 427 and the drain electrode 428, and functions as an active layer. An insulating film 429 is formed over the oxide semiconductor film 425, the source electrode 427, and the drain electrode 428, and the transistor 421 may include the insulating film 429 as a component.

Further, the capacitor 422 includes an electrode 430, the insulating film 424 over the electrode 430, and an electrode 431 over the insulating film 424.

The transistor 421 may further include a back-gate electrode over the insulating film 429. The back-gate electrode is formed so as to overlap with a channel formation region of the oxide semiconductor film 425. Further, the back-gate electrode may be electrically insulated and in a floating state, or may be in a state where the back-gate electrode is supplied with a potential. In the latter case, the back-gate electrode may be supplied with a potential at the same level as the gate electrode 423, or may be supplied with a fixed potential such as a ground potential. By controlling the level of the potential supplied to the back-gate electrode, it is possible to control the threshold voltage of the transistor 421.

Figure 12C:
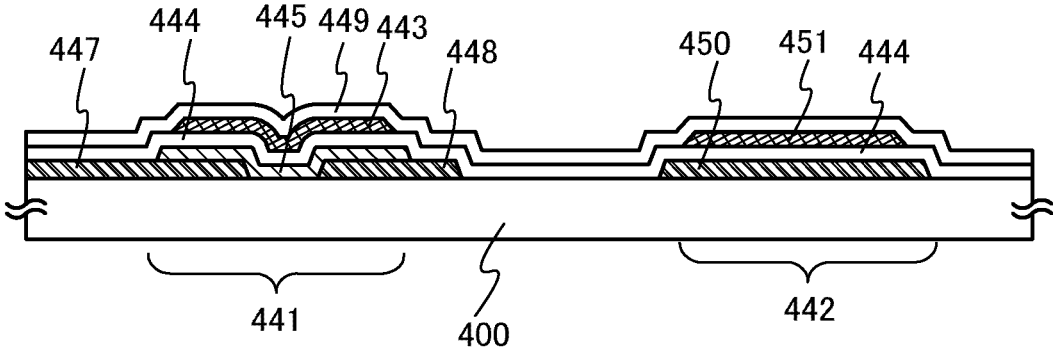

FIG. 12C illustrates an example in which a transistor 441 and a capacitor 442 which are second semiconductor elements and have structures different from those in FIG. 12A and FIG. 12B are formed over the second substrate 400.

The transistor 441 includes, over the second substrate 400 having an insulating surface, a source electrode 447 and a drain electrode 448, an oxide semiconductor film 445 which is over the source electrode 447 and the drain electrode 448 and functions as an active layer, an insulating film 444 over the oxide semiconductor film 445, and a gate electrode 443 which overlaps with the oxide semiconductor film 445 with the insulating film 444 positioned therebetween. An insulating film 449 is formed over the gate electrode 443, and the transistor 441 may include the insulating film 449 as a component.

Further, the capacitor 442 includes an electrode 450, the insulating film 444 over the electrode 450, and an electrode 451 over the insulating film 444.

Note that it is found that an oxide semiconductor film formed by sputtering or the like includes a large amount of impurities such as moisture or hydrogen. Moisture or hydrogen easily forms a donor level and thus serve as an impurity in the oxide semiconductor. Thus, heat treatment is performed on an oxide semiconductor film in a nitrogen atmosphere, an oxygen atmosphere, ultra dry air, or a rare gas (such as argon or helium) atmosphere in order to reduce impurities such as moisture or hydrogen in the oxide semiconductor film and to purify the oxide semiconductor film. It is preferable that the content of water in the gas be less than or equal to 20 ppm, preferably less than or equal to 1 ppm, and further preferably less than or equal to 10 ppb. The above heat treatment is preferably performed at higher than or equal to 500° C. and lower than or equal to 850° C. (or lower than or equal to a strain point of a glass substrate), further preferably higher than or equal to 550° C. and lower than or equal to 750° C. Note that this heat treatment is performed at a temperature not exceeding the allowable temperature limit of the substrate to be used. An effect of elimination of moisture or hydrogen by heat treatment is confirmed by thermal desorption spectroscopy (TDS).

This embodiment can be implemented in combination with any of the above embodiments as appropriate.

Embodiment 6

In this embodiment, a method for connecting terminals in the case where a first substrate is directly mounted on a second substrate will be described.

Figure 13A:
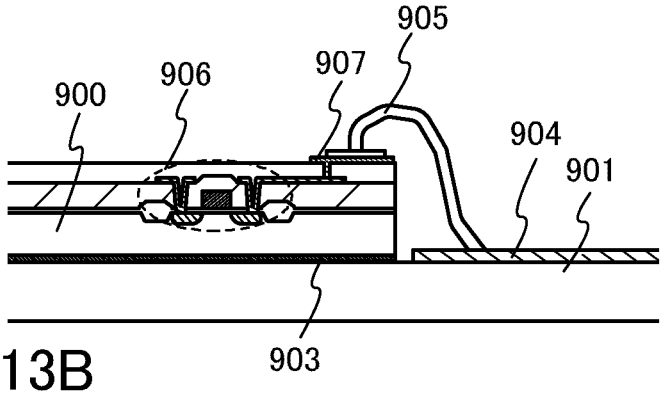
FIGS. 13A to 13C are views illustrating embodiments of connection between terminals.

FIG. 13A is a cross-sectional view of a portion where a first substrate 900 and a second substrate 901 are connected to each other by a wire bonding method. The first substrate 900 is attached on the second substrate 901 with an adhesive 903. The first substrate 900 is provided with a first semiconductor element 906. Further, the first semiconductor element 906 is electrically connected to a pad 907 which is formed to be exposed on a surface of the first substrate 900 and functions as a terminal A terminal 904 is formed over the second substrate 901 in FIG. 13A, and the pad 907 and the terminal 904 are connected to each other through a wire 905.

Figure 13B:
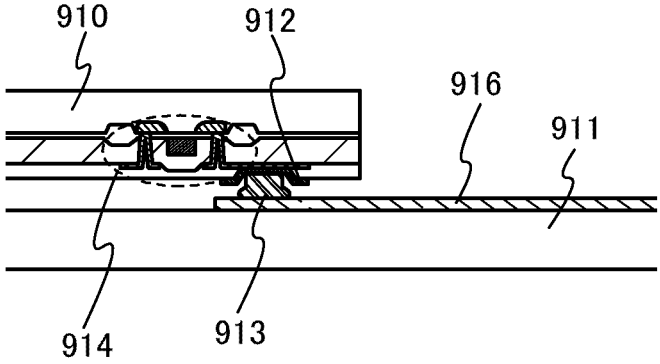

Next, FIG. 13B is a cross-sectional view of a portion where a first substrate and a second substrate are connected to each other by a flip-chip method. In FIG. 13B, a solder ball 913 is connected to a pad 912 which is formed to be exposed on a surface of a first substrate 910. Thus, a first semiconductor element 914 formed on the first substrate 910 is electrically connected to the solder ball 913 through the pad 912. Further, the solder ball 913 is connected to a terminal 916 formed over a second substrate 911.

Note that the solder ball 913 and the terminal 916 can be connected by various methods such as thermocompression bonding or thermocompression bonding with vibration by ultrasonic waves. The mechanical strength of the connection portion or the efficiency of diffusion or the like of heat generated in the second substrate 911 may be increased by providing an underfill between the first substrate 910 and the second substrate 911 so that a space between solder balls is filled after pressure bonding. The underfill is not necessarily used; however, the provision of the underfill can prevent a connection defect due to a stress caused by a mismatch between thermal expansion coefficients of the first substrate 910 and the second substrate 911. When thermocompression bonding is performed by application of ultrasonic waves, occurrence of a connection defect can be suppressed as compared to the case where only thermocompression bonding is performed. The thermocompression bonding by application of ultrasonic waves is particularly effective when the number of connection portions is more than approximately 300.

The flip-chip method, by which a relatively wide pitch can be secured between pads as compared to by a wire bonding method even when the number of pads to be connected is increased, is suitable for the case of connecting a large number of terminals.

Note that the solder ball may be formed by a droplet discharge method in which dispersion liquid where metal nanoparticles are dispersed is discharged.

Figure 13C:
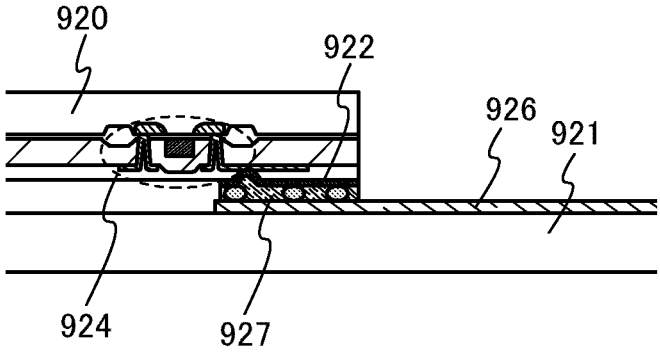

Next, FIG. 13C is a cross-sectional view of a portion where a first substrate and a second substrate are connected to each other with the use of an anisotropic conductive resin. In FIG. 13C, a pad 922 which is formed to be exposed on a surface of a first substrate 920 is electrically connected to a first semiconductor element 924 formed on the first substrate 920. Further, the pad 922 is connected to a terminal 926 formed over a second substrate 921 through an anisotropic conductive resin 927.

Note that the connection method is not limited to the methods illustrated in FIGS. 13A to 13C. Connection may be performed by a combination of a wire bonding method and a flip-chip method.

This embodiment can be implemented in combination with any of the above embodiments as appropriate.

Embodiment 7

In this embodiment, a method for mounting a first substrate will be described.

Figure 14A:
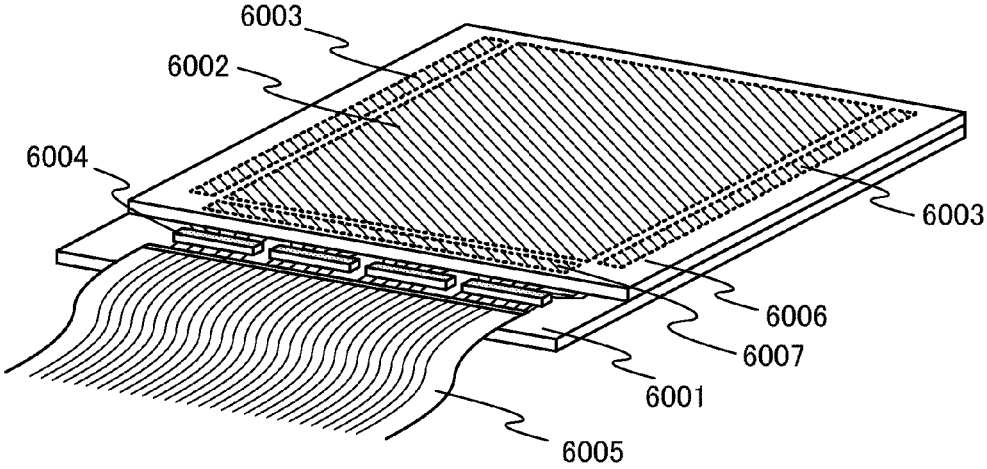
FIGS. 14A and 14B are views illustrating embodiments of mounting.
Figure 14B:
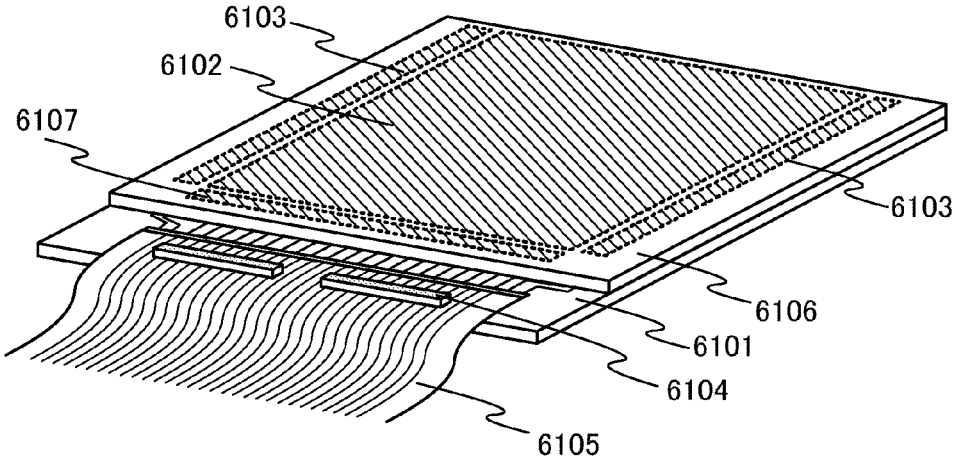

FIGS. 14A and 14B are each a perspective view of a semiconductor display device in which a chip-like first substrate is mounted on a second substrate.

In the semiconductor display device illustrated in FIG. 14A, a pixel portion 6002, a scan line driver circuit 6003, and a second signal line driver circuit 6007 are provided between a second substrate 6001 and a counter substrate 6006. Further, a first substrate 6004 provided with a first signal line driver circuit is directly mounted on the second substrate 6001.

Specifically, the first signal line driver circuit formed over the first substrate 6004 is attached to the second substrate 6001 and electrically connected to the second signal line driver circuit 6007. Further, a power supply potential, a variety of signals, and the like are supplied through an FPC 6005 to the pixel portion 6002, the scan line driver circuit 6003, the second signal line driver circuit 6007, and the first signal line driver circuit formed over the first substrate 6004.

In the semiconductor display device illustrated in FIG. 14B, a pixel portion 6102, a scan line driver circuit 6103, and a second signal line driver circuit 6107 are provided between a second substrate 6101 and a counter substrate 6106. Further, a first substrate 6104 provided with a first signal line driver circuit is mounted on an FPC 6105 connected to the second substrate 6101. A power supply potential, a variety of signals, and the like are supplied through the FPC 6105 to the pixel portion 6102, the scan line driver circuit 6103, the second signal line driver circuit 6107, and the first signal line driver circuit formed over the first substrate 6104.

There is no particular limitation on a method for mounting the first substrate, and a known method such as a COG method, a wire bonding method, or a TAB method can be used. Further, a position where the IC chip is mounted is not limited to the positions shown in FIGS. 14A and 14B as long as electrical connection is possible. In addition, an IC chip including a controller, a CPU, a memory, or the like may be formed and mounted on the second substrate.

This embodiment can be implemented in combination with any of the above embodiments.

Embodiment 8

When a transistor having low off-state current and high reliability is used for a pixel portion of a liquid crystal display device according to an embodiment of the present invention, high visibility and high reliability can be obtained. In this embodiment, a structure of a liquid crystal display device according to an embodiment of the present invention will be described.

Figure 15:
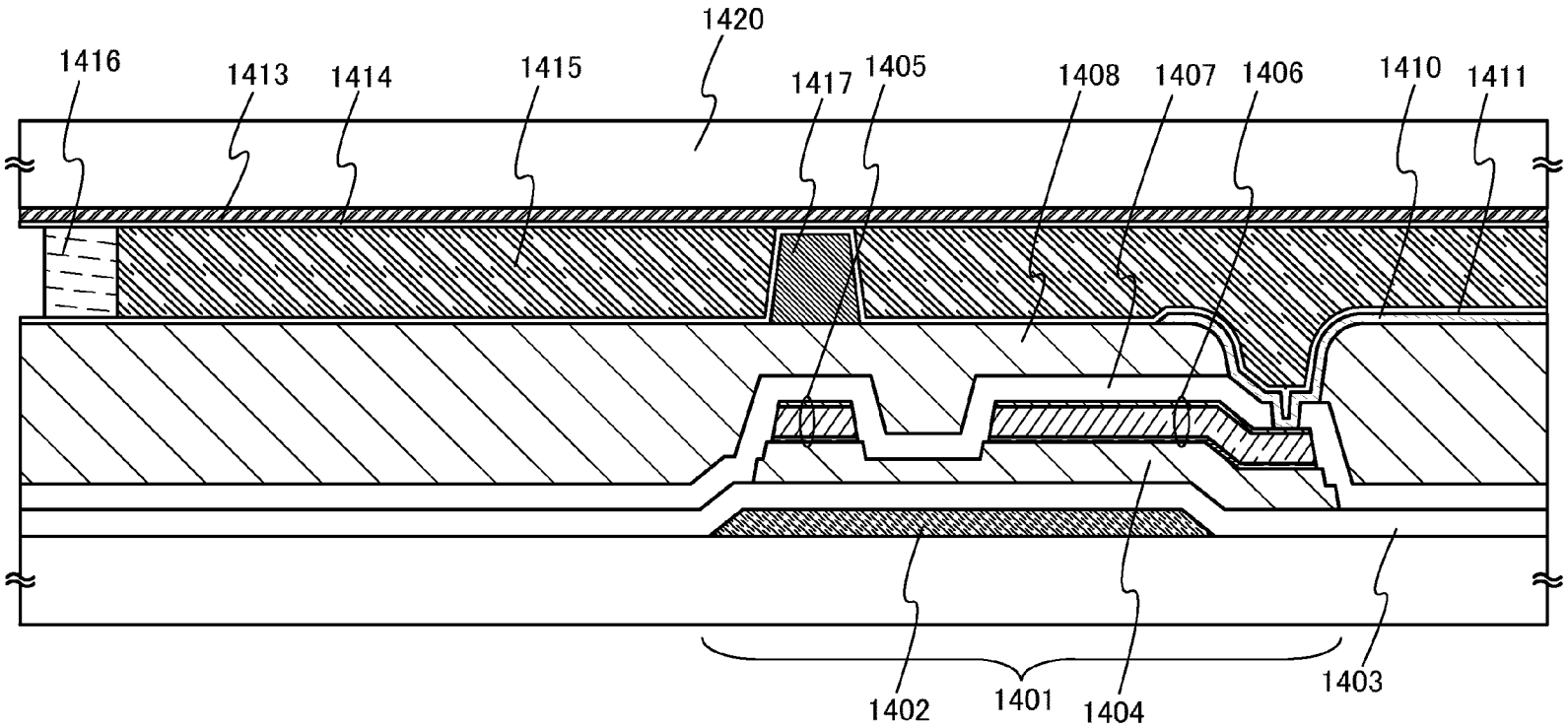
FIG. 15 is a cross-sectional view of a pixel of a liquid crystal display device.

FIG. 15 illustrates an example of a cross-sectional view of a pixel in a liquid crystal display device according to an embodiment of the present invention. A transistor 1401 illustrated in FIG. 15 includes a gate electrode 1402 formed over an insulating surface, a gate insulating film 1403 over the gate electrode 1402, an oxide semiconductor film 1404 which is over the gate insulating film 1403 and overlaps with the gate electrode 1402, and a conductive film 1405 and a conductive film 1406 which are formed over the oxide semiconductor film 1404 and function as a source electrode and a drain electrode. Further, the transistor 1401 may include an insulating film 1407 formed over the oxide semiconductor film 1404 as a component. The insulating film 1407 is formed so as to cover the gate electrode 1402, the gate insulating film 1403, the oxide semiconductor film 1404, the conductive film 1405, and the conductive film 1406.

An insulating film 1408 is formed over the insulating film 1407. An opening is provided in part of the insulating film 1407 and the insulating film 1408, and a pixel electrode 1410 is formed so as to be in contact with the conductive film 1406 in the opening.

Further, a spacer 1417 for controlling a cell gap of a liquid crystal element is formed over the insulating film 1408. An insulating film is etched to have a desired shape, so that the spacer 1417 can be formed. The cell gap may also be controlled by dispersing a filler over the insulating film 1408.

An alignment film 1411 is formed over the pixel electrode 1410. Further, a counter electrode 1413 is provided in a position that faces the pixel electrode 1410, and an alignment film 1414 is formed on the side of the counter electrode 1413 which is close to the pixel electrode 1410. The alignment film 1411 and the alignment film 1414 can be formed using an organic resin such as polyimide or polyvinyl alcohol. Alignment treatment such as rubbing is performed on their surfaces in order to align liquid crystal molecules in a certain direction. Rubbing can be performed by rolling a roller wrapped with cloth of nylon or the like while pressure is applied on the alignment film so that the surface of the alignment film is rubbed in a certain direction. Note that it is also possible to form the alignment films 1411 and 1414 that have alignment characteristics with the use of an inorganic material such as silicon oxide by an evaporation method, without alignment treatment.

Furthermore, a liquid crystal 1415 is provided in a region which is surrounded by a sealant 1416 between the pixel electrode 1410 and the counter electrode 1413. Injection of the liquid crystal 1415 may be performed by a dispenser method (dripping method) or a dipping method (pumping method). Note that a filler may be mixed in the sealant 1416.

The liquid crystal element formed using the pixel electrode 1410, the counter electrode 1413, and the liquid crystal 1415 may overlap with a color filter through which light in a particular wavelength region can pass. The color filter may be formed over a substrate (counter substrate) 1420 provided with the counter electrode 1413. The color filter can be selectively formed by photolithography after application of an organic resin such as an acrylic-based resin in which pigment is dispersed on the substrate 1420. Alternatively, the color filter can be selectively formed by etching after application of a polyimide-based resin in which pigment is dispersed on the substrate 1420. Further alternatively, the color filter can be selectively formed by a droplet discharge method such as ink jetting.

A light-blocking film which can block light may be formed between the pixels so that disclination due to disorder of alignment of the liquid crystal 1415 between pixels is prevented from being observed. The light-blocking film can be formed using an organic resin including black pigment such as carbon black or titanium lower oxide. Alternatively, a film of chromium can be used as the light-blocking film.

The pixel electrode 1410 and the counter electrode 1413 can be formed using a transparent conductive material such as indium tin oxide including silicon oxide (ITSO), indium tin oxide (ITO), zinc oxide (ZnO), indium zinc oxide (IZO), or zinc oxide to which gallium is added (GZO), for example. Note that in this embodiment, an example in which a transmissive liquid crystal element is manufactured using a light-transmitting conductive film for the pixel electrode 1410 and the counter electrode 1413 is described; however, an embodiment of the present invention is not limited to this structure. The liquid crystal display device according to an embodiment of the present invention may be a semi-transmissive liquid crystal display device or a reflective liquid crystal display device.

Although a liquid crystal display device of a twisted nematic (TN) mode is described in this embodiment, other liquid crystal display devices of a vertical alignment (VA) mode, an optically compensated birefringence (OCB) mode, an in-plane switching (IPS) mode, a multi-domain vertical alignment (MVA) mode, and the like may be employed.

Alternatively, liquid crystals exhibiting a blue phase for which an alignment film is unnecessary may be used. A blue phase is one of liquid crystal phases, which is generated just before a cholesteric phase changes into an isotropic phase when temperature of cholesteric liquid crystals is increased. Since the blue phase is generated within only a narrow range of temperature, a liquid crystal composition in which a chiral agent is mixed at 5 wt % or more is used for the liquid crystal 1415 in order to improve the temperature range. The liquid crystal composition including liquid crystals exhibiting a blue phase and a chiral agent has a short response time of greater than or equal to 10 μsec and less than or equal to 100 μsec and is optically isotropic; therefore, alignment treatment is not necessary and viewing angle dependence is small.

Figure 16A:
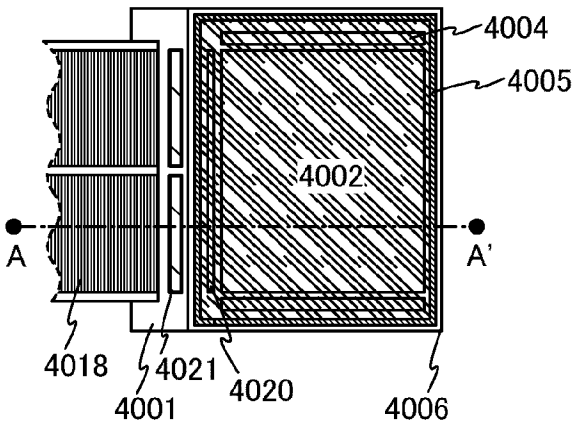
FIG. 16A is a top view and FIG. 16B is a cross-sectional view of a panel.
Figure 16B:
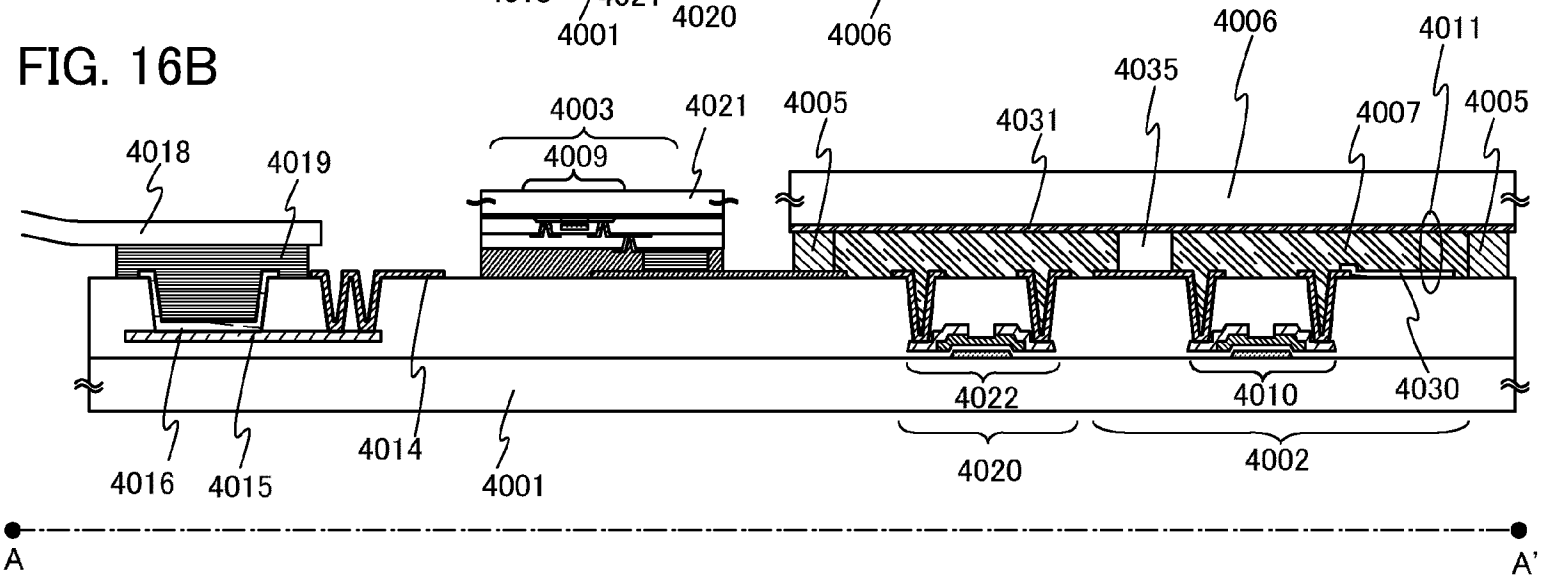

Next, the appearance of a panel of a liquid crystal display device according to an embodiment of the present invention will be described with reference to FIGS. 16A and 16B. FIG. 16A is a top view of a panel in which a second substrate 4001 and a counter substrate 4006 are attached to each other with a sealant 4005. FIG. 16B is a cross-sectional view along dashed line A-A' in FIG. 16A.

The sealant 4005 is provided so as to surround a pixel portion 4002, a scan line driver circuit 4004, and a second signal line driver circuit 4020 which are provided over the second substrate 4001. Further, the counter substrate 4006 is provided over the pixel portion 4002, the scan line driver circuit 4004, and the second signal line driver circuit 4020. Thus, the pixel portion 4002, the scan line driver circuit 4004, and the second signal line driver circuit 4020 are sealed together with a liquid crystal 4007 by the second substrate 4001, the sealant 4005, and the counter substrate 4006.

A first substrate 4021 provided with a first signal line driver circuit 4003 is mounted in a region which is over the second substrate 4001 and different from the region surrounded by the sealant 4005. FIG. 16B illustrates a transistor 4009 which corresponds to a first semiconductor element included in the first signal line driver circuit 4003, as an example.

A plurality of transistors is included in the pixel portion 4002, the scan line driver circuit 4004, and the second signal line driver circuit 4020 which are formed over the second substrate 4001. FIG. 16B illustrates a transistor 4010 included in the pixel portion 4002 and a transistor 4022 included in the second signal line driver circuit 4020, as examples. The transistor 4010 and the transistor 4022 correspond to second semiconductor elements including an oxide semiconductor.

A pixel electrode 4030 included in a liquid crystal element 4011 is electrically connected to the transistor 4010. A counter electrode 4031 of the liquid crystal element 4011 is formed over the counter substrate 4006. A portion where the pixel electrode 4030, the counter electrode 4031, and the liquid crystal 4007 overlap with one another corresponds to the liquid crystal element 4011.

A spacer 4035 is provided to control a distance (cell gap) between the pixel electrode 4030 and the counter electrode 4031. Note that FIG. 16B illustrates the case where the spacer 4035 is formed by patterning an insulating film, as an example; however, a spherical spacer may be used.

A variety of signals and potentials which are applied to the first signal line driver circuit 4003, the second signal line driver circuit 4020, the scan line driver circuit 4004, and the pixel portion 4002 are supplied from a connection terminal 4016 through lead wirings 4014 and 4015. The connection terminal 4016 is electrically connected to a terminal of an FPC 4018 through an anisotropic conductive film 4019.

Note that for the second substrate 4001, the counter substrate 4006, and the first substrate 4021, glass, ceramics, or plastics can be used. Plastics include, in its category, a fiberglass-reinforced plastic (FRP) plate, a polyvinyl fluoride (PVF) film, a polyester film, an acrylic resin film, and the like. In addition, a sheet having a structure in which an aluminum foil is sandwiched between PVF films can be used.

Note that a substrate placed in a direction in which light is extracted through the liquid crystal element 4011 is formed using a light-transmitting material such as a glass plate, plastic, a polyester film, or an acrylic film.

Figure 17:
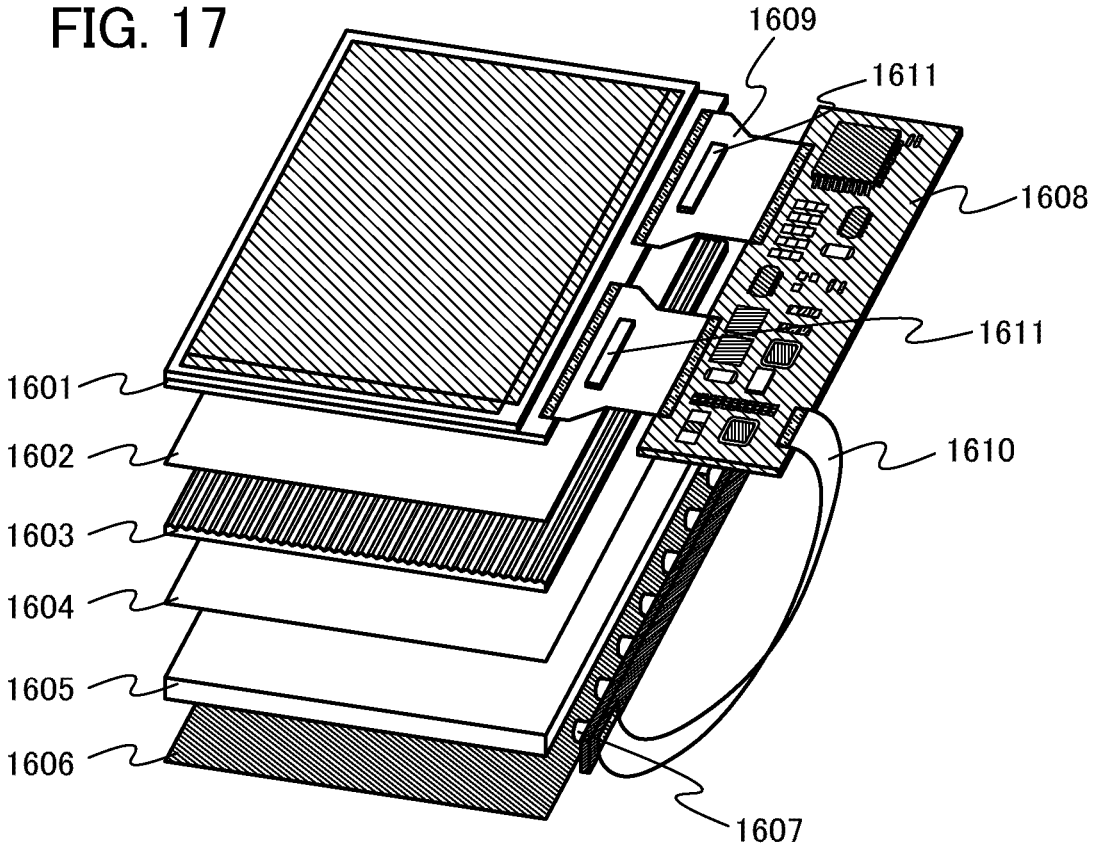
FIG. 17 is a perspective view illustrating a structure of a liquid crystal display device.

FIG. 17 is an example of a perspective view illustrating a structure of a liquid crystal display device according to an embodiment of the present invention. The liquid crystal display device illustrated in FIG. 17 includes a panel 1601 in which a liquid crystal element is formed between a second substrate and a counter substrate, a first diffusion plate 1602, a prism sheet 1603, a second diffusion plate 1604, a light guide plate 1605, a reflection plate 1606, a light source 1607, a circuit board 1608, and a first substrate 1611.

The panel 1601, the first diffusion plate 1602, the prism sheet 1603, the second diffusion plate 1604, the light guide plate 1605, and the reflection plate 1606 are sequentially stacked. The light source 1607 is provided at an end portion of the light guide plate 1605. Light from the light source 1607 is diffused inside the light guide plate 1605 and is uniformly delivered to the panel 1601 with the help of the first diffusion plate 1602, the prism sheet 1603, and the second diffusion plate 1604.

Although the first diffusion plate 1602 and the second diffusion plate 1604 are used in this embodiment, the number of diffusion plates is not limited to this. The number of diffusion plates may be one, or may be three or more. The diffusion plate is provided between the light guide plate 1605 and the panel 1601. Therefore, the diffusion plate may be provided only on the side closer to the panel 1601 than the prism sheet 1603, or may be provided only on the side closer to the light guide plate 1605 than the prism sheet 1603.

Further, the cross section of the prism sheet 1603 is not limited to a sawtooth shape illustrated in FIG. 17. The prism sheet 1603 may have a shape with which light from the light guide plate 1605 can be concentrated on the panel 1601 side.

The circuit board 1608 is provided with a circuit which generates various signals input to the panel 1601, a circuit which processes the signals, or the like. In FIG. 17, the circuit board 1608 and the panel 1601 are connected to each other through a COF tape 1609. Further, the first substrate 1611 is connected to the COF tape 1609 by a chip on film (COF) method.

FIG. 17 illustrates an example in which the circuit board 1608 is provided with a control circuit which controls driving of the light source 1607 and the control circuit and the light source 1607 are connected to each other through an FPC 1610. Note that the above control circuit may be formed over the panel 1601; in this case, the panel 1601 and the light source 1607 are connected to each other through an FPC or the like.

Although FIG. 17 illustrates an edge-light type light source and the light source 1607 is provided at an end of the panel 1601 as an example, the liquid crystal display device of an embodiment of the present invention may be a direct-below type in which the light source 1607 is provided directly below the panel 1601.

This embodiment can be implemented in combination with any of the above embodiments as appropriate.

Embodiment 9

In this embodiment, a specific structure of a pixel portion will be described by taking a light-emitting device which is one of semiconductor display devices of the present invention as an example.

Figure 19:
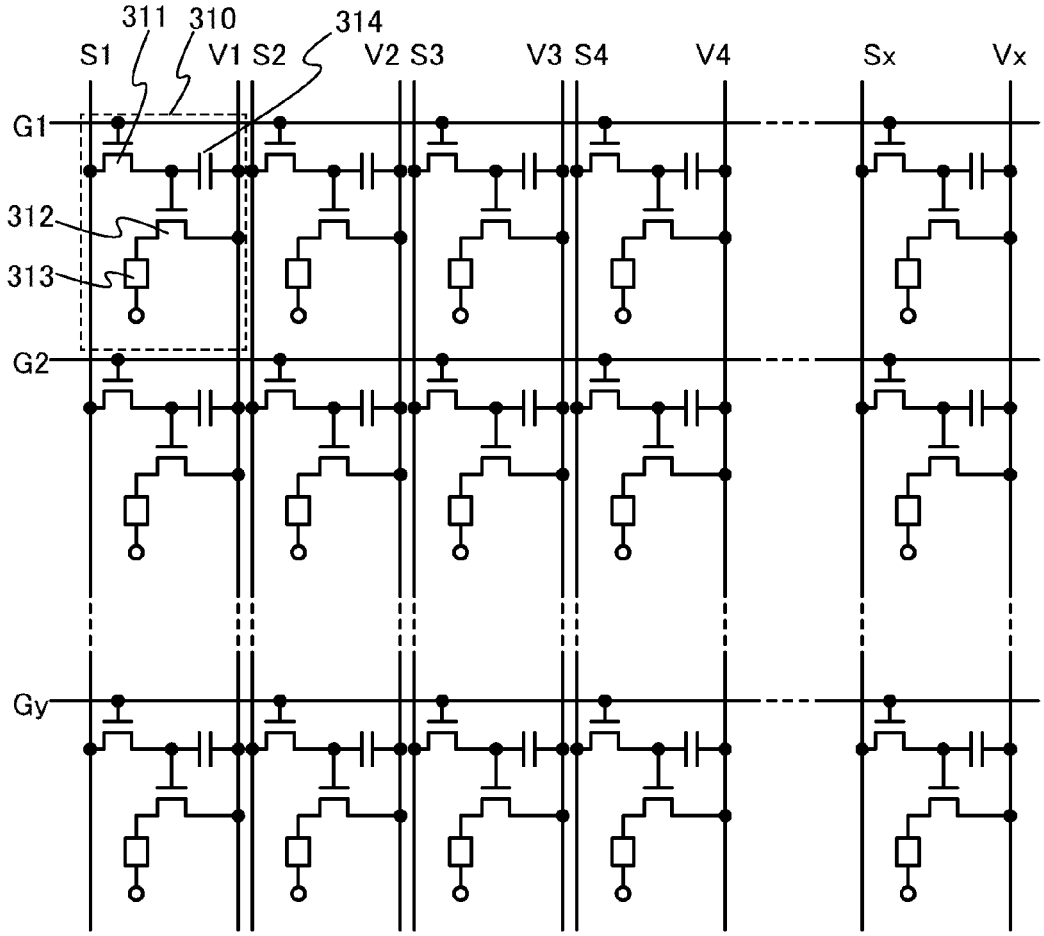
FIG. 19 is a circuit diagram illustrating a configuration of a pixel portion.

FIG. 19 is a circuit diagram of a pixel portion in a light-emitting device in which a light-emitting element typified by an organic light-emitting diode (OLED) is provided in each pixel. The pixel portion in FIG. 19 includes a plurality of signal lines S1 to Sx, a plurality of power supply lines V1 to Vx, and a plurality of scan lines G1 to Gy. Each of the plurality of pixels 310 has at least one of the signal lines S1 to Sx, one of the power supply lines V1 to Vx, and one of the scan lines G1 to Gy.

Each of the pixels 310 includes a light-emitting element 313, a switching transistor 311 that controls input of a video signal to the pixel 310, and a driving transistor 312 that controls the amount of current supplied to the light-emitting element 313. A gate electrode of the switching transistor 311 is connected to one of the scan lines G1 to Gy. One of a source electrode and a drain electrode of the switching transistor 311 is connected to one of the signal lines S1 to Sx. The other of the source electrode and the drain electrode of the switching transistor 311 is connected to a gate electrode of the driving transistor 312. One of a source electrode and a drain electrode of the driving transistor 312 is connected to one of the power supply lines V1 to Vx. The other of the source electrode and the drain electrode of the driving transistor 312 is connected to a pixel electrode of the light-emitting element 313. Further, the pixel 310 includes a storage capacitor 314. One electrode of the storage capacitor 314 is connected to one of the power supply lines V1 to Vx. The other electrode of the storage capacitor 314 is connected to the gate electrode of the driving transistor 312.

The light-emitting element 313 includes an anode, a cathode, and an electroluminescent layer provided between the anode and the cathode. One of the anode and the cathode is used as a pixel electrode, and the other of the anode and the cathode is used as a counter electrode. When the anode is connected to the source electrode or the drain electrode of the driving transistor 312, the anode is the pixel electrode and the cathode is the counter electrode. On the other hand, when the cathode is connected to the source electrode or the drain electrode of the driving transistor 312, the cathode is the pixel electrode and the anode is the counter electrode.

Voltage is applied to the counter electrode of the light-emitting element 313 and the power supply line from the power source. The value of the voltage difference between the counter electrode and the power supply line is kept such that forward bias voltage is applied to the light-emitting element when the driving transistor 312 is turned on.

When the switching transistor 311 is turned on by a pulse of a selection signal input to the scan line, the voltage of the video signal input to a signal line is applied to the gate electrode of the driving transistor 312. The gate voltage of the driving transistor 312 (voltage difference between the gate electrode and the source electrode) is determined in accordance with the voltage of the input video signal. Then, drain current of the driving transistor 312 which flows in accordance with the gate voltage is supplied to the light-emitting element 313, so that the light-emitting element 313 emits light.

In the case where an image is displayed in a specific area, a selection signal having a pulse is sequentially input only to scan lines included in pixels in the area. Then, a video signal having image data is input only to signal lines included in the pixels in the area, so that the image can be displayed in the specific area.

The structure of the pixel 310 illustrated in FIG. 19 is just an example of the pixel included in the semiconductor display device of an embodiment of the present invention, and an embodiment of the present invention is not limited to the configuration of the pixel illustrated in FIG. 19.

Note that in the light-emitting device, grayscale display may be performed by a time ratio grayscale method in which time during which a pixel displays white for one frame period is controlled, or by using a video signal having analog image data. Since the response time of a light-emitting element is shorter than that of a liquid crystal element or the like, the light-emitting element is more suitable for a time ratio grayscale method than the liquid crystal element. Specifically, in the case of displaying by a time ratio grayscale method, one frame period is divided into a plurality of subframe periods. Then, in accordance with video signals, the light-emitting element in the pixel is brought into a light-emitting state or a non-light-emitting state in each subframe period. With the above structure, the total length of a period during which the pixel actually in a light-emitting state in one frame period can be controlled by the video signals, so that grayscale display can be performed.

This embodiment can be implemented in combination with any of the above embodiments as appropriate.

Embodiment 10

In this embodiment, a specific structure of a pixel portion will be described by taking an electrophoretic display device called electronic paper or digital paper, which is one of semiconductor display devices of the present invention, as an example.

A display element which can control grayscale by voltage application and has a memory property is used for an electrophoretic display device. Specifically, as the display element used for the electrophoretic display device, a non-aqueous electrophoretic display element; a display element that employs a polymer dispersed liquid crystal (PDLC) method, in which liquid crystal droplets are dispersed in a high molecular material between two electrodes; a display element that includes a chiral nematic liquid crystal or a cholesteric liquid crystal between two electrodes; a display element that includes charged fine particles between two electrodes and employs a particle-moving method in which the charged fine particles are moved through fine particles by using an electric field; or the like can be used. Further, examples of a non-aqueous electrophoretic display element include a display element in which dispersion liquid where charged fine particles are dispersed is sandwiched between two electrodes; a display element in which dispersion liquid where charged fine particles are dispersed is provided over two electrodes between which an insulating film is sandwiched; a display element in which twisting balls having hemispheres that are colored in different colors and charged differently are dispersed in a solvent between two electrodes; and a display element which includes microcapsules where a plurality of charged fine particles are dispersed in a solution, between two electrodes.

Figure 20:
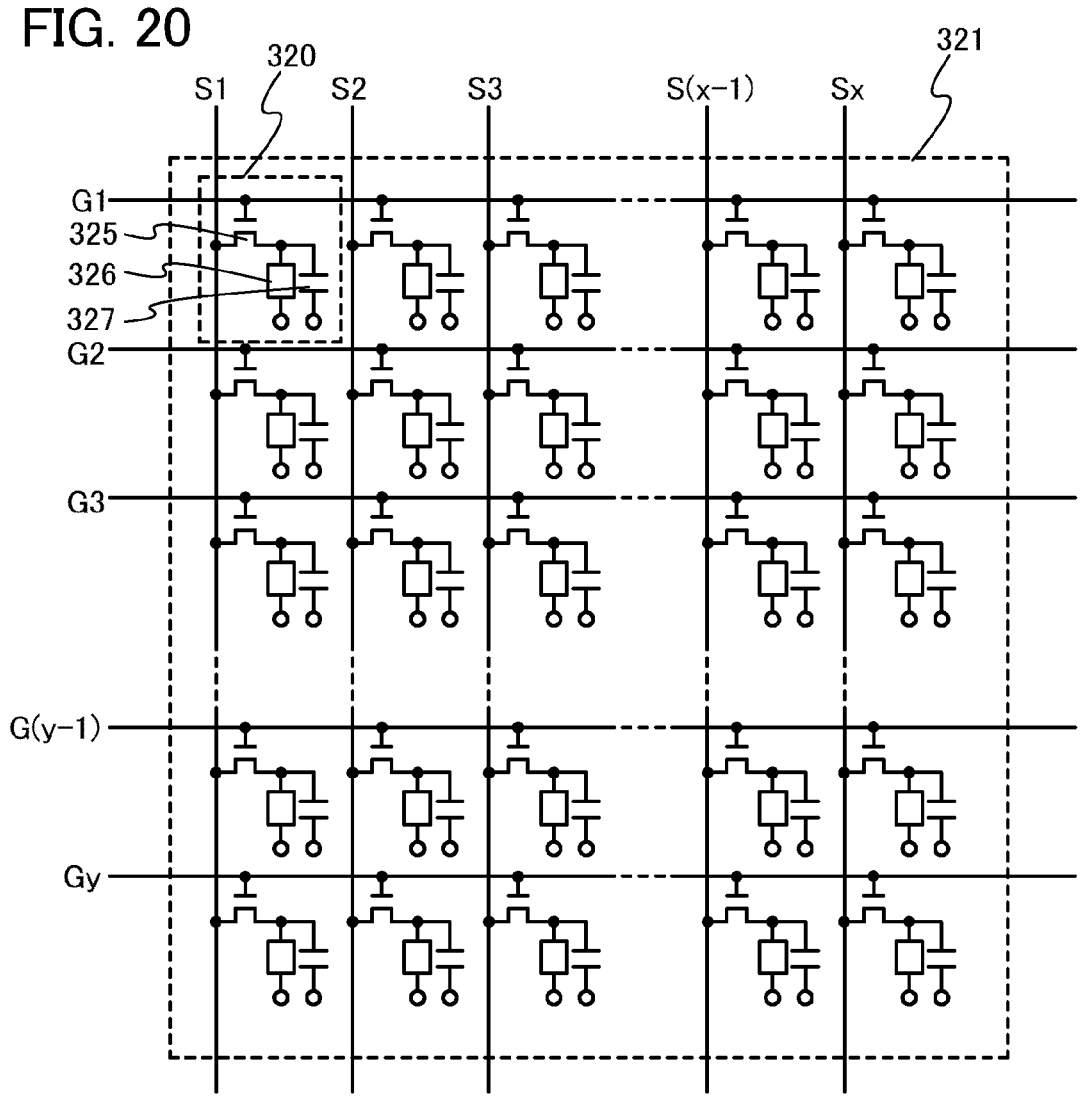
FIG. 20 is a circuit diagram illustrating a configuration of a pixel portion.

FIG. 20 illustrates a circuit diagram of a pixel portion 321 of an electrophoretic display device, as an example. The pixel portion 321 includes a plurality of pixels 320. The pixel portion 321 includes a plurality of signal lines S1 to Sx and a plurality of scan lines G1 to Gy. Each of the plurality of pixels 320 has at least one of the signal lines S1 to Sx and one of the scan lines G1 to Gy.

Each of the pixels 320 includes a transistor 325, a display element 326, and a storage capacitor 327. A gate electrode of the transistor 325 is connected to one of the scan lines G1 to Gy. One of a source electrode and a drain electrode of the transistor 325 is connected to one of the signal lines S1 to Sx, and the other of the source electrode and the drain electrode of the transistor 325 is connected to a pixel electrode of the display element 326.

Note that in FIG. 20, the storage capacitor 327 is connected in parallel to the display element 326 such that voltage applied between the pixel electrode and a counter electrode of the display element 326 is held; in the case where the memory property of the display element 326 is high enough to maintain display, the storage capacitor 327 is not necessarily provided.

Note that FIG. 20 illustrates a configuration of an active-matrix pixel portion in which one transistor functioning as a switching element is provided in each pixel; however, the electrophoretic display device according to an embodiment of the present invention is not limited to this configuration. A plurality of transistors may be provided in each pixel. Further, other than transistors, an element such as a capacitor, a resistor, or a coil may be connected.

As described above, the structure of the display element 326 depends on the kind of the electrophoretic display device. For example, in the case of an electrophoretic display device including microcapsules, the display element 326 includes a pixel electrode, a counter electrode, and microcapsules to which voltage is applied by the pixel electrode and the counter electrode. One of the source electrode and the drain electrode of the transistor 325 is connected to the pixel electrode.

In the microcapsules, positively charged white pigment such as titanium oxide and negatively charged black pigment such as carbon black are sealed together with a dispersion medium such as oil. Voltage is applied between the pixel electrode and the counter electrode in accordance with the voltage of a video signal applied to the pixel electrode, and the black pigment and the white pigment are drawn to a positive electrode side and a negative electrode side, respectively. Thus, binary grayscale display can be performed.

In the case of an electrophoretic display device, display of intermediate grayscale can be performed with the use of a digital image processing technique such as an error diffusion method or a dither method.

Note that voltage needed to change the grayscale levels of the display element used in an electrophoretic display device tends to be higher than that needed for a liquid crystal element used in a liquid crystal display device or a light-emitting element such as an organic light-emitting element used in a light-emitting device. Therefore, the potential difference between the source electrode and the drain electrode of the transistor 325 in a pixel which is used as a switching element is large when a video signal is written; as a result, off-state current is increased and disturbance of display is likely to occur owing to fluctuation of the potential of the pixel electrode. Moreover, since the potential difference between the source electrode and the drain electrode is increased, the transistor 325 is easily deteriorated. According to an embodiment of the present invention, however, an oxide semiconductor is used for a channel formation region of the transistor 325, whereby the off-state current thereof can be significantly reduced and the withstand voltage thereof can be increased. Accordingly, display can be prevented from being disturbed by the off-state current. According to an embodiment of the present invention, variation in the threshold voltage of the transistor 325 due to degradation over time can be reduced, so that reliability of the electrophoretic display device can be increased.

This embodiment can be implemented in combination with any of the above embodiments.

Example

With the use of a semiconductor display device according to an embodiment of the present invention, an electronic device having high reliability or an electronic device capable of displaying a high-quality image can be provided.

The semiconductor display device according to an embodiment of the present invention can be used for display devices, laptop computers, or image reproducing devices provided with recording media (typically, devices which reproduce the content of recording media such as digital versatile discs (DVDs) and have displays for displaying the reproduced images). Further, the electronic devices for which the semiconductor display device according to an embodiment of the present invention can be used are as follows: mobile phones, portable game machines, portable information terminals, electronic book readers, video cameras, digital still cameras, goggle-type displays (head mounted displays), navigation systems, audio reproducing devices (such as car audio systems and digital audio players), copiers, facsimiles, printers, multifunction printers, automated teller machines (ATMs), vending machines, and the like. Specific examples of these electronic devices are illustrated in FIGS. 18A to 18D.

Figure 18A:
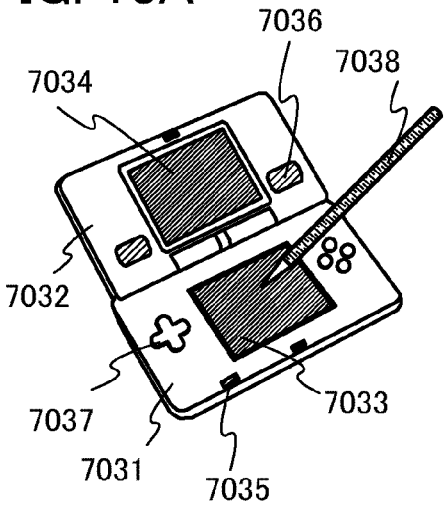
FIGS. 18A to 18D are views of electronic devices.

FIG. 18A illustrates a portable game machine including a housing 7031, a housing 7032, a display portion 7033, a display portion 7034, a microphone 7035, a speaker 7036, an operation key 7037, a stylus 7038, and the like. The semiconductor display device according to an embodiment of the present invention can be used for the display portion 7033 or the display portion 7034. By using the semiconductor display device according to an embodiment of the present invention for the display portion 7033 or the display portion 7034, the portable gate machine can have high reliability and display a high-quality image. Although the portable game machine illustrated in FIG. 18A has the two display portions 7033 and 7034, the number of display portions included in the portable game machine is not limited to this.

Figure 18B:
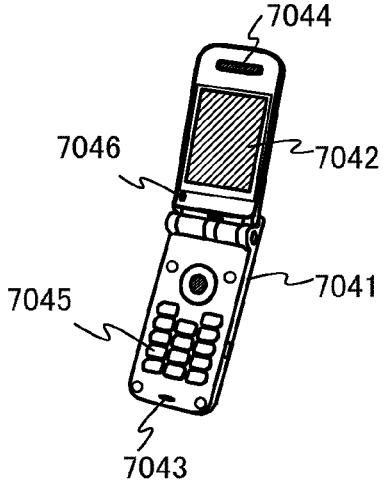

FIG. 18B illustrates a mobile phone including a housing 7041, a display portion 7042, an audio-input portion 7043, an audio-output portion 7044, an operation key 7045, a light-receiving portion 7046, and the like. Light received in the light-receiving portion 7046 is converted to electrical signals, whereby external images can be loaded. The semiconductor display device according to an embodiment of the present invention can be used for the display portion 7042. By using the semiconductor display device according to an embodiment of the present invention for the display portion 7042, the mobile phone can have high reliability and display a high-quality image.

Figure 18C:
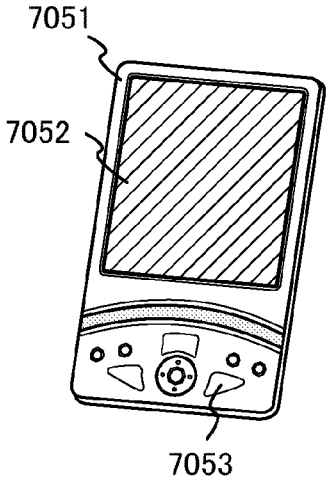

FIG. 18C illustrates a portable information terminal including a housing 7051, a display portion 7052, an operation key 7053, and the like. In the portable information terminal illustrated in FIG. 18C, a modem may be incorporated in the housing 7051. The semiconductor display device according to an embodiment of the present invention can be used for the display portion 7052. By using the semiconductor display device according to an embodiment of the present invention for the display portion 7052, the portable information terminal can have high reliability and display a high-quality image.

Figure 18D:
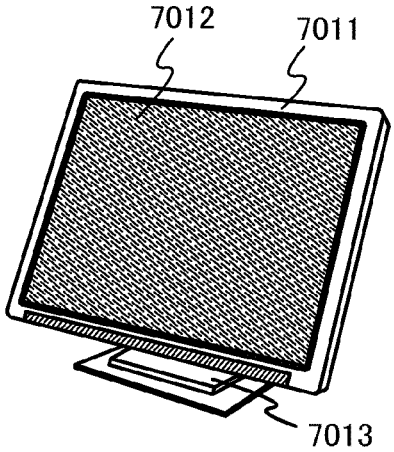

FIG. 18D illustrates a display device including a housing 7011, a display portion 7012, a support 7013, and the like. The semiconductor display device according to an embodiment of the present invention can be used for the display portion 7012. By using the semiconductor display device according to an embodiment of the present invention for the display portion 7012, the display device can have high reliability and display a high-quality image. Note that a display device includes all display devices for displaying information, such as display devices for personal computers, for receiving television broadcast, and for displaying advertisement, in its category.

This example can be implemented in combination with any of the above embodiments as appropriate.

This application is based on Japanese Patent Application serial no. 2010-080661 filed with Japan Patent Office on Mar. 31, 2010, the entire contents of which are hereby incorporated by reference.

The invention claimed is:

1. A semiconductor display device comprising:

a pixel portion; and a signal line driver circuit comprising a first circuit, a second circuit, and a third circuit, wherein the first circuit is configured to sample serial video signals and to convert the serial video signals to parallel video signals, wherein the second circuit is configured to control timing of the sampled serial video signals by the first circuit, wherein the third circuit is configured to perform signal processing on the parallel video signals, wherein the second circuit comprises a first semiconductor element formed over a first substrate, the first semiconductor element including a first semiconductor layer, wherein the third circuit comprises a second semiconductor element formed over a second substrate, the second semiconductor element including a second semiconductor layer, wherein the pixel portion comprises a third semiconductor element formed over the second substrate, the third semiconductor element including a third semiconductor layer, wherein the first semiconductor layer comprises silicon or germanium, and wherein each the second semiconductor layer and the third semiconductor layer has a wider bandgap than the first semiconductor layer.

2. The semiconductor display device according to claim 1, wherein the first circuit includes a fourth semiconductor element formed over the first substrate, and wherein the fourth semiconductor element comprises silicon or germanium.

3. The semiconductor display device according to claim 1, wherein the first circuit includes a fifth semiconductor element formed over the second substrate, and wherein the fifth semiconductor element comprises the second semiconductor layer.

4. The semiconductor display device according to claim 1, wherein a withstand voltage of the second semiconductor element is more than 10V higher than that of the first semiconductor element.

5. The semiconductor display device according to claim 1, wherein a withstand voltage of the second semiconductor element is higher than 5 V and approximately lower than or equal to 20 V.

6. The semiconductor display device according to claim 1, wherein each the first to third semiconductor element is a transistor.

7. The semiconductor display device according to claim 1, wherein at least one of the second and third semiconductor layers comprises an oxide semiconductor.

8. The semiconductor display device according to claim 7, wherein the oxide semiconductor is an In—Ga—Zn—O-based oxide semiconductor.

9. A semiconductor display device comprising:

a pixel portion;

a scan line driver circuit; and a signal line driver circuit comprising a first circuit, a second circuit, and a third circuit, wherein the first circuit is configured to sample serial video signals and to convert the serial video signals to parallel video signals, wherein the second circuit is configured to control timing of the sampled serial video signals by the first circuit, wherein the third circuit is configured to perform signal processing on the parallel video signals, wherein the second circuit comprises a first semiconductor element formed over a first substrate, the first semiconductor element including a first semiconductor layer, wherein the third circuit comprises a second semiconductor element formed over a second substrate, the second semiconductor element including a second semiconductor layer, wherein the pixel portion comprises a third semiconductor element formed over the second substrate, the third semiconductor element including a third semiconductor layer, wherein the first semiconductor layer comprises silicon or germanium, and wherein each the second semiconductor layer and the third semiconductor layer has a wider bandgap than the first semiconductor layer.

10. The semiconductor display device according to claim 9, wherein the first circuit includes a fourth semiconductor element formed over the first substrate, and wherein the fourth semiconductor element comprises silicon or germanium.

11. The semiconductor display device according to claim 9, wherein the first circuit includes a fifth semiconductor element formed over the second substrate, and wherein the fifth semiconductor element comprises the second semiconductor layer.

12. The semiconductor display device according to claim 9, wherein a withstand voltage of the second semiconductor element is more than 10V higher than that of the first semiconductor element.

13. The semiconductor display device according to claim 9, wherein a withstand voltage of the second semiconductor element is higher than 5 V and approximately lower than or equal to 20 V.

14. The semiconductor display device according to claim 9, wherein each the first to third semiconductor element is a transistor.

15. The semiconductor display device according to claim 9, wherein at least one of the second and third semiconductor layers comprises an oxide semiconductor.

16. The semiconductor display device according to claim 15, wherein the oxide semiconductor is an In—Ga—Zn—O-based oxide semiconductor.

17. A semiconductor display device comprising:

a pixel portion;

a shift register;

a memory circuit;

a D/A converter circuit; and a level shifter, wherein the shift register comprises a first semiconductor element formed over a first substrate, the first semiconductor element including a first semiconductor layer, wherein the level shifter comprises a second semiconductor element formed over a second substrate, the second semiconductor element including a second semiconductor layer, wherein the pixel portion comprises a third semiconductor element formed over the second substrate, the third semiconductor element including a third semiconductor layer, wherein the first semiconductor layer comprises silicon or germanium, and wherein each the second semiconductor layer and the third semiconductor layer has a wider bandgap than the first semiconductor layer.

18. The semiconductor display device according to claim 17, wherein the memory circuit includes a fourth semiconductor element formed over the first substrate, and wherein the fourth semiconductor element comprises silicon or germanium.

19. The semiconductor display device according to claim 17, wherein the D/A converter circuit includes a fifth semiconductor element formed over the second substrate, and wherein the fifth semiconductor element comprises the second semiconductor layer.

20. The semiconductor display device according to claim 17, wherein a withstand voltage of the second semiconductor element is more than 10V higher than that of the first semiconductor element.

21. The semiconductor display device according to claim 17, wherein a withstand voltage of the second semiconductor element is higher than 5 V and approximately lower than or equal to 20 V.

22. The semiconductor display device according to claim 17, wherein each the first to third semiconductor element is a transistor.

23. The semiconductor display device according to claim 17, wherein at least one of the second and third semiconductor layers comprises an oxide semiconductor.

24. The semiconductor display device according to claim 23, wherein the oxide semiconductor is an In—Ga—Zn—O-based oxide semiconductor.

25. The semiconductor display device according to claim 17, wherein the memory circuit is configured to sample serial video signals and to convert the serial video signals to parallel video signals.

* * * * *